US011691427B2

(12) United States Patent
Oya et al.

(10) Patent No.: US 11,691,427 B2
(45) Date of Patent: Jul. 4, 2023

(54) CARTRIDGE, PRINTING DEVICE, AND PRINTING SYSTEM

(71) Applicant: SEIKO EPSON CORPORATION, Tokyo (JP)

(72) Inventors: Shun Oya, Kiso-machi (JP); Yoshihiro Koizumi, Shiojiri (JP); Takumi Nagashima, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 32 days.

(21) Appl. No.: 17/552,470

(22) Filed: Dec. 16, 2021

(65) Prior Publication Data

US 2022/0194087 A1 Jun. 23, 2022

(30) Foreign Application Priority Data

Dec. 17, 2020 (JP) ..... 2020-209177

(51) Int. Cl.
*B41J 2/175* (2006.01)

(52) U.S. Cl.
CPC ..... *B41J 2/17523* (2013.01); *B41J 2/17513* (2013.01); *B41J 2/17553* (2013.01)

(58) Field of Classification Search
CPC ..... B41J 2/17523; B41J 2/17513; B41J 2/17553; B41J 2/17509; B41J 2/1752; B41J 2/17596; B41J 29/13; B41J 2/1753
USPC ..... 347/86
See application file for complete search history.

(56) References Cited

U.S. PATENT DOCUMENTS 7,350,909 B2 4/2008 Takagi et al.
2002/0036680 A1* 3/2002 Hall ..... B41J 2/17506 347/85

FOREIGN PATENT DOCUMENTS

JP 2005-254734 A 9/2005

* cited by examiner

*Primary Examiner* — Matthew Luu
*Assistant Examiner* — Alexander D Shenderov
(74) *Attorney, Agent, or Firm* — Oliff PLC

(57) ABSTRACT

A cartridge includes a liquid containing portion and a liquid supply portion that includes a cartridge side valve mechanism, the cartridge side valve mechanism includes a cartridge side valve seat in which a cartridge side valve hole is formed, a cartridge side valve body that stops the cartridge side valve hole and has a tip surface positioned adjacent to the supply opening, and a cartridge side urging member that urges the cartridge side valve body in a direction toward the cartridge side valve seat, and the cartridge side valve body has a protrusion that protrudes from the tip surface and pushes the device side valve body to open the device side valve body.

9 Claims, 26 Drawing Sheets

CARTRIDGE, PRINTING DEVICE, AND PRINTING SYSTEM

The present application is based on, and claims priority from JP Application Serial Number 2020-209177, filed Dec. 17, 2020, the disclosure of which is hereby incorporated by reference herein in its entirety. cl BACKGROUND

1. Technical Field

The present disclosure relates to a technology for a cartridge, a printing device, and a printing system.

2. Related Art

A related technology, in which an ink cartridge mounted on a printing device includes an ink supply valve capable of opening/closing an ink supply flow path for supplying ink, has been known (JP-A-2005-254734). The ink supply valve includes a valve seat portion, a valve body, and an urging portion that urges the valve body toward the valve seat portion. As an ink supply pipe of the printing device is inserted into the ink supply flow path of the ink cartridge, the valve body is pushed up against an urging force by the ink supply pipe, such that the valve body is separated from the valve seat portion. As a result, the ink supply valve is opened. Further, the valve body includes a breaking portion protruding toward an ink chamber of the ink cartridge. As the valve body is pushed up, the breaking portion breaks a thin film portion blocking the ink supply flow path. As a result, the ink can be supplied from the ink cartridge toward a printer.

In the related technology, the ink cartridge side supply flow path is opened and closed by the ink supply valve, but opening/closing of the ink supply pipe that receives the ink from the printing device have not been considered. Such a problem is not limited to the ink cartridge, but is common to cartridges containing a liquid and detachably mounted on the printing device.

SUMMARY

According to a first aspect of the present disclosure, there is provided a cartridge detachably mounted in a cartridge mounting portion of a printing device including a liquid introduction portion that receives a liquid and a device side valve body that opens/closes an introduction portion flow path which is a flow path of the liquid introduction portion. The cartridge includes a liquid containing portion that contains the liquid, and a liquid supply portion that has a supply opening formed at a tip, communicates with the liquid containing portion, is coupled to the liquid introduction portion, and includes a cartridge side valve mechanism that opens/closes a supply portion flow path which is the flow path of the liquid supply portion, the cartridge side valve mechanism includes a cartridge side valve seat in which a cartridge side valve hole is formed, a cartridge side valve body that stops the cartridge side valve hole and has a tip surface positioned on a side of the supply opening, and a cartridge side urging member that urges the cartridge side valve body in a direction toward the cartridge side valve seat, and the cartridge side valve body has a protrusion that protrudes from the tip surface and pushes the device side valve body to open the device side valve body.

According to a second aspect of the present disclosure, there is provided a printing device in which a cartridge is mounted. The cartridge includes a liquid supply portion and a cartridge side valve body for opening/closing a supply portion flow path which is a flow path of the liquid supply portion, the cartridge side valve body having a protrusion that protrudes from a tip surface. Further, the printing device includes an ejecting head that ejects a liquid, and a cartridge mounting portion in which the cartridge is mounted and which includes a liquid introduction portion coupled to the liquid supply portion and receiving the liquid, the liquid introduction portion has an introduction portion opening formed at a tip and an introduction portion flow path which is a flow path, and includes a device side valve body that opens/closes the introduction portion flow path, and the device side valve body is arranged at a position at which the device side valve body is pushed by the protrusion and is opened.

According to a third aspect of the present disclosure, there is provided a printing system. The printing system includes the cartridge of the above aspect, and the printing device of the above aspect, as the cartridge is moved downward, the liquid introduction portion and the liquid supply portion are coupled to each other, and in a supply portion coupling process in which the liquid introduction portion and the liquid supply portion are coupled to each other, the device side valve body is opened earlier than the cartridge side valve body.

DESCRIPTION OF EXEMPLARY EMBODIMENTS

A. Embodiment

A-1. Configuration of Printing System

Figure 1:
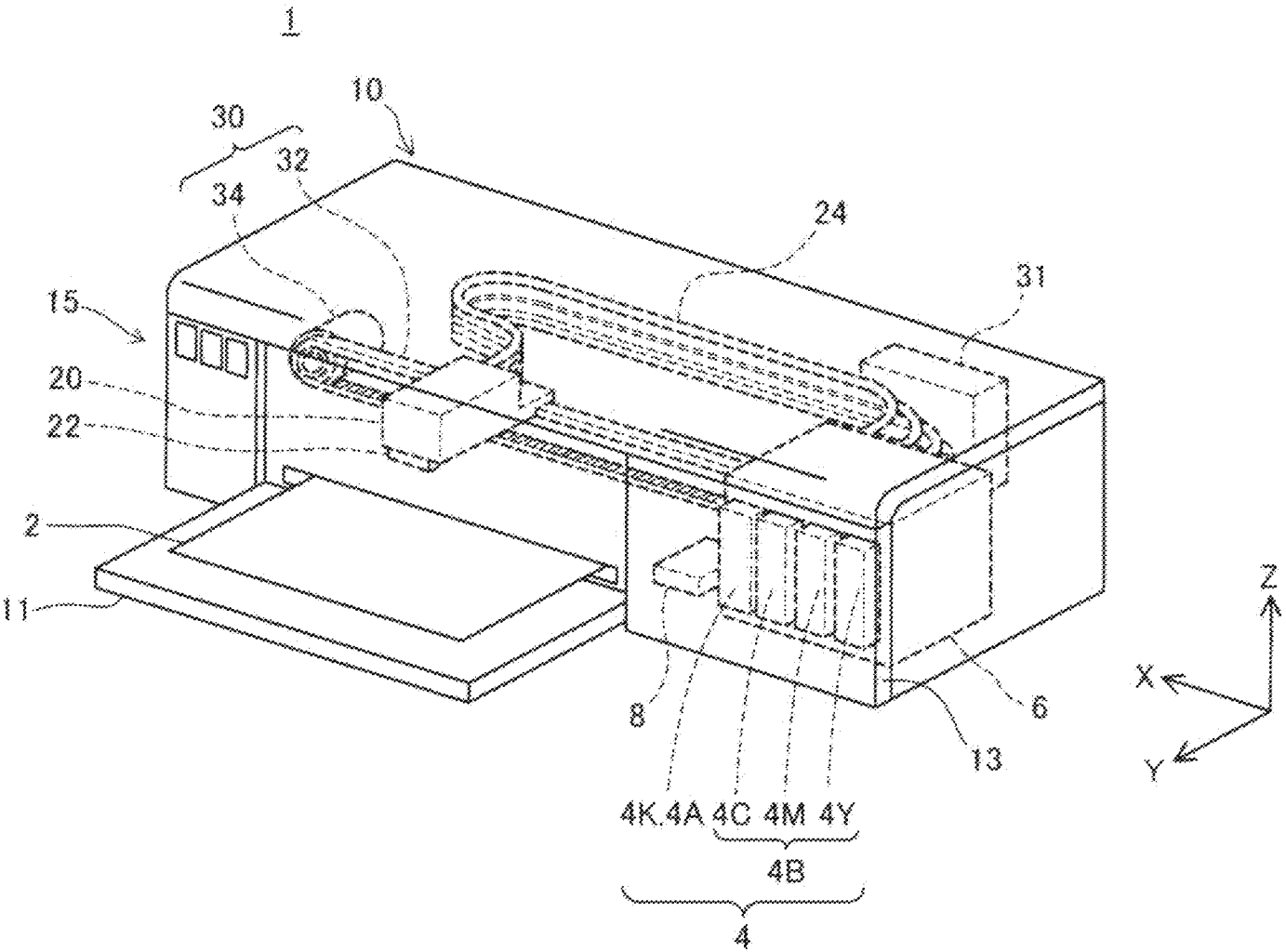
FIG. 1 is a perspective view illustrating a configuration of a printing system as an embodiment of the present disclosure.

FIG. 1 is a perspective view illustrating a configuration of a printing system 1 as an embodiment of the present disclosure. In FIG. 1, XYZ axes, which are three spatial axes orthogonal to each other, are drawn. Directions toward which arrows of the X axis, the Y axis, and the Z axis point are positive directions along the X axis, the Y axis, and the Z axis, respectively. The positive directions along the X axis, the Y axis, and the Z axis are a +X direction, a +Y direction, and a +Z direction, respectively. Directions opposite to the directions toward which the arrows of the X axis, the Y axis, and the Z axis point are negative directions along the X axis, the Y axis, and the Z axis, respectively. The negative directions along the X axis, the Y axis, and the Z axis are a −X direction, a −Y direction, and a −Z direction, respectively. The directions along the X axis, the Y axis, and the Z axis, regardless of whether they are positive or negative, are referred to as an X direction, a Y direction, and a Z direction, respectively. The same applies to drawings and a description shown below.

The printing system 1 includes a printing device 10 and a cartridge 4 that supplies ink, which is a liquid, to the printing device 10.

The printing device 10 of the present embodiment is an ink jet printer that ejects ink as a liquid, from an ejection head 22. The printing device 10 is a large-sized printer that performs printing on large-sized papers (A2 to A0 and the like) such as a poster. The printing device 10 includes a cartridge mounting portion 6, a control portion 31, a carriage 20, the ejection head 22, and a drive mechanism 30. In addition, the printing device 10 includes an operation button 15 for a user to operate an operation of the printing device 10.

A plurality of cartridges 4 are each detachably mounted in the cartridge mounting portion 6. In the present embodiment, four types of cartridges 4 corresponding to inks of four colors of black, yellow, magenta, and cyan, respectively, that is, a total of four cartridges 4 are mounted in the cartridge mounting portion 6. A cartridge 4 containing black ink is also referred to as a cartridge 4K, a cartridge 4 containing yellow ink is also referred to as a cartridge 4Y, a cartridge 4 containing magenta ink is also referred to as a cartridge 4M, and a cartridge 4 containing cyan ink is also referred to as a cartridge 4C. In the present embodiment, the cartridge 4K is configured to be able to contain a more liquid than the cartridges 4C, 4M, and 4Y. Therefore, the cartridge 4K is also referred to as a first type of cartridge 4A, and each of the cartridges 4C, 4M, and 4Y is also referred to as a second type of cartridge 4B.

The printing device 10 includes a replacement cover 13 on a front surface of a +Y direction side. When a +Z direction side of the replacement cover 13 is tilted toward a front side which is the +Y direction side, an opening of the cartridge mounting portion 6 appears, and attachment and detachment of the cartridge 4 becomes possible. When the cartridge 4 is mounted in the cartridge mounting portion 6, ink can be supplied to the ejection head 22 provided on the carriage 20 via tubes 24 as liquid flow pipes. In the present embodiment, the ink is supplied from the cartridge 4 to the ejection head 22 by using a head difference. Specifically, the ink is supplied to the ejection head 22 by a head difference between a liquid level of the ink in a liquid storage portion 699 and the ejection head 22. Note that, in another embodiment, the ink may be supplied to the ejection head 22 by sucking the ink in the cartridge 4 by a pump mechanism (not illustrated) of the printing device 10. Note that the tubes 24 are provided for each type of ink. Note that a state in which the cartridge 4 is mounted in the cartridge mounting portion 6 and the ink as the liquid can be supplied to the printing device 10 is also referred to as a "mounted state".

The ejection head 22 is provided with a nozzle for each type of ink. The ejection head 22 ejects the ink from the nozzle toward a printing paper 2 to print data such as characters or images. Note that a state of mounting the cartridge 4 in the cartridge mounting portion 6 or detailed configurations of the cartridge 4 and the cartridge mounting portion 6 will be described later. Note that in the present embodiment, the printing device 10 is a so-called "off-carriage type" printer in which the cartridge mounting portion 6 is not interlocked to movement of the carriage 20. The present disclosure can also be applied to a so-called "on-carriage type" printer in which the cartridge mounting portion 6 is provided on the carriage 20 and moves together with the carriage 20.

The control portion 31 performs control of each portion of the printing device 10 or transmission and reception of a signal to and from the cartridge 4. The carriage 20 moves the ejection head 22 relative to the printing paper 2.

The drive mechanism 30 reciprocates the carriage based on a control signal from the control portion 31. The drive mechanism 30 includes a timing belt 32 and a drive motor 34. By transmitting power of the drive motor 34 to the carriage 20 via the timing belt 32, the carriage 20 reciprocates in a main scanning direction, which is a direction along the X direction. In addition, the printing device 10 includes a transport mechanism for moving the printing paper 2 in a sub-scanning direction, which is the +Y direction. When printing is performed, the printing paper 2 is moved in the sub-scanning direction by the transport mechanism, and the printing paper 2 after printing is completed is output onto a front cover 11.

In addition, a region referred to as a home position is provided at a position outside a printing region where the carriage 20 is moved in the main scanning direction, and a maintenance mechanism that performs maintenance for normally executing the printing is mounted at the home position. The maintenance mechanism includes a cap member 8 that is pressed against a surface on which the nozzle is formed on a bottom surface side of the ejection head 22 to form a closed space so as to surround the nozzle, an elevating and lowering mechanism (not illustrated) that elevates and lowers the cap member 8 in order to press the cap member 8 against the nozzle surface of the ejection head 22, a suction pump (not illustrated) that introduces a negative pressure into the closed space formed by pressing the cap member 8 against the nozzle surface of the ejection head 22, or the like.

In the present embodiment, in a use state of the printing system 1, an axis along the sub-scanning direction in which the printing paper 2 is transported is the Y axis, an axis along a gravity direction is the Z axis, and an axis along a moving direction of the carriage 20 is the X axis. Here, the "use state of the printing system 1" refers to a state in which the printing system 1 is installed on a horizontal surface. In addition, in the present embodiment, the sub-scanning direction is the +Y direction, an opposite direction to the +Y direction is the −Y direction, the gravity direction is the −Z direction, and an antigravity direction is the +Z direction. The X direction and the Y direction are directions along a horizontal direction. In addition, when the printing system 1 is viewed from a front side, a direction from a right side to a left side is the +X direction, and an opposite direction to the +X direction is the −X direction. In addition, in the present embodiment, an insertion direction in which the cartridge 4 is inserted into the cartridge mounting portion 6 for mounting is the −Y direction, and a direction in which the cartridge 4 is removed from the cartridge mounting portion 6 is the +Y direction. Therefore, a −Y direction side of the cartridge mounting portion 6 is also referred to as a rear side, and a +Y direction side of the cartridge mounting portion 6 is also referred to as a front side. In addition, in the present embodiment, an arrangement direction of the plurality of cartridges 4 is the X direction.

A-2. Schematic Configuration of Mounted State of Cartridge 4

Figure 2:
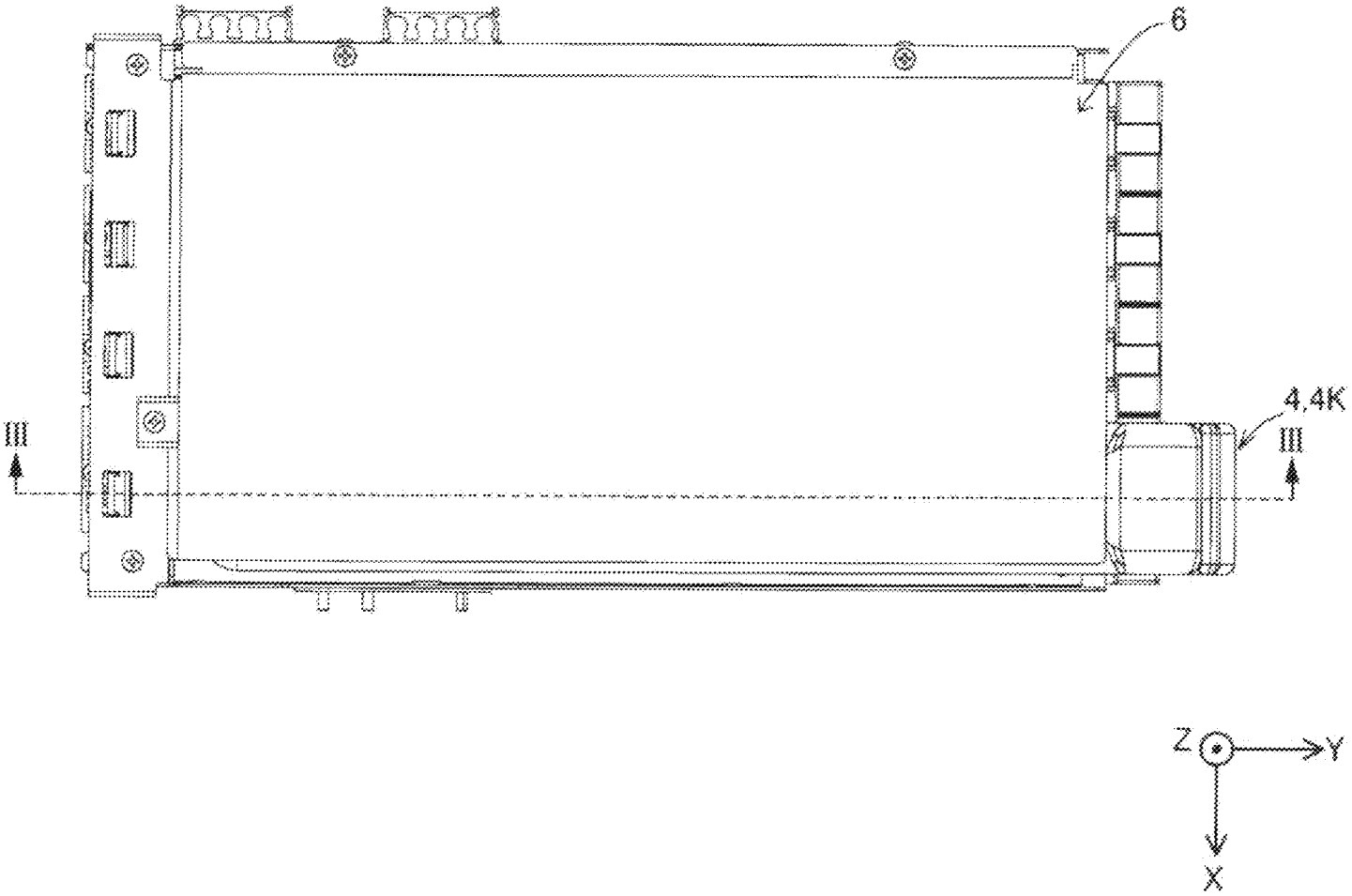
FIG. 2 is a view of a cartridge mounting portion when viewed from a +Z direction side.
Figure 3:
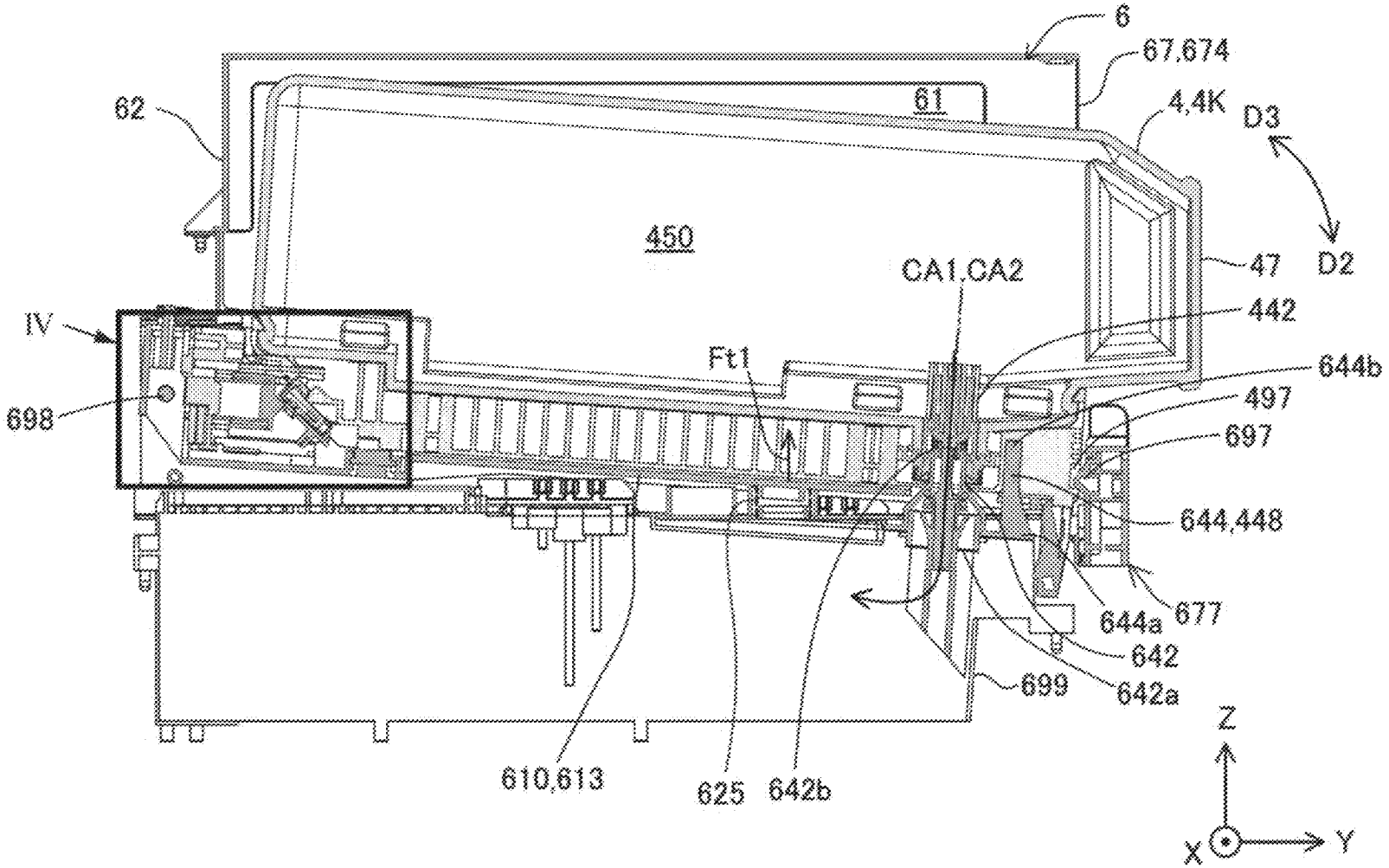
FIG. 3 is a sectional view taken along line III-III of FIG. 2.
Figure 4:
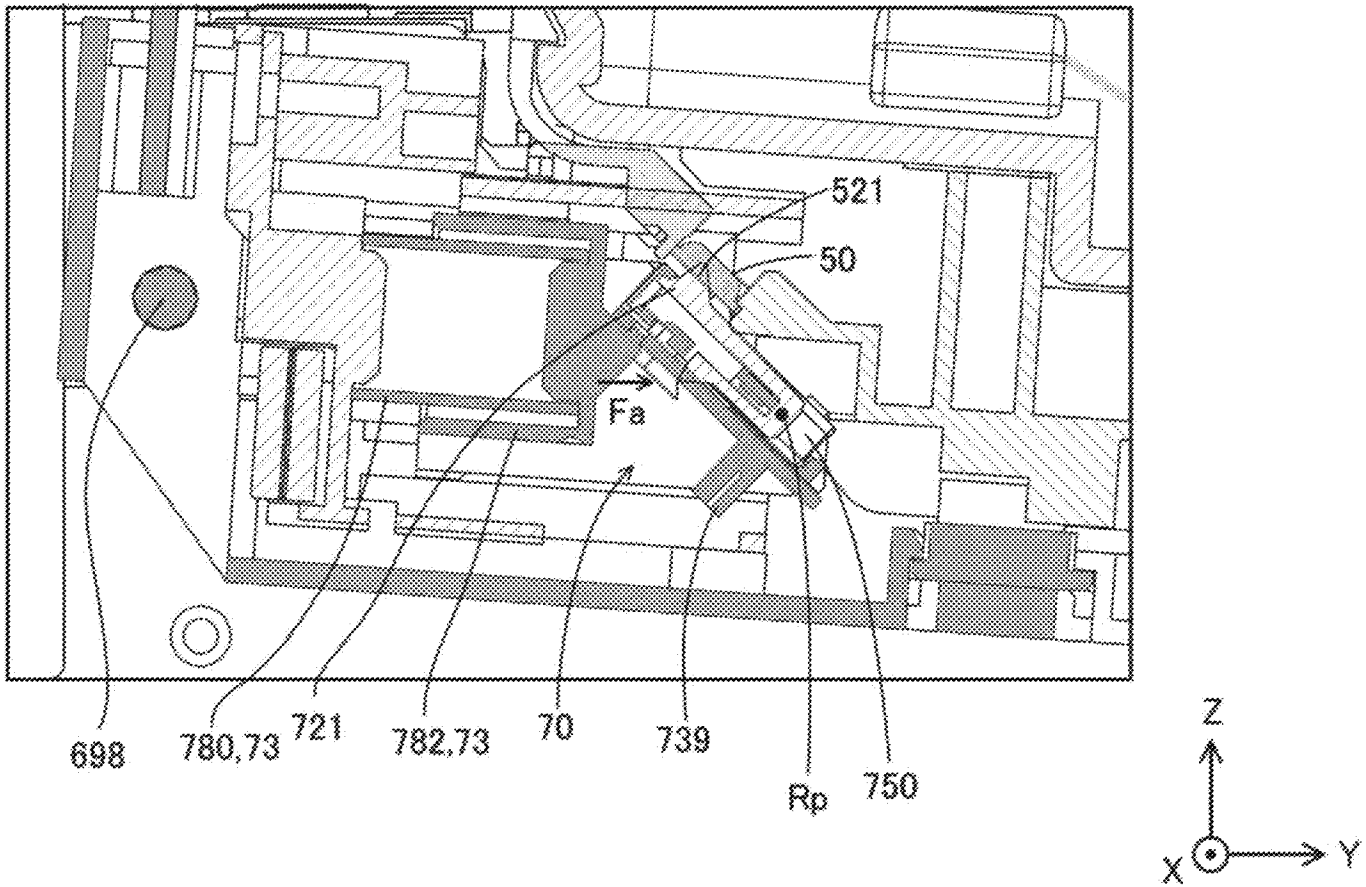
FIG. 4 is an enlarged view of region IV of FIG. 3.

FIG. 2 is a view of the cartridge mounting portion 6 when viewed from the +Z direction side. FIG. 3 is a sectional view taken along line III-III of FIG. 2. FIG. 4 is an enlarged view of region IV of FIG. 3. In FIG. 2, the cartridge 4K is mounted in the cartridge mounting portion 6. A schematic configuration of a mounting process and a mounted state of the cartridge 4 will be described with reference to FIGS. 2 to 4. Note that the mounting process and mounted state are the same for the cartridges 4C, 4M, 4Y, and 4K.

As illustrated in FIG. 3, the cartridge 4 is inserted along the insertion direction, and is inserted into an accommodation chamber 61 of the cartridge mounting portion 6 through an insertion/removal opening 674 of a first device wall 67 of the cartridge mounting portion 6. As a result, the accommodation chamber 61 accommodates the cartridge 4. The insertion/removal opening 674 is an entrance to the accommodation chamber 61 of the cartridge 4. In a state in which the cartridge 4 is inserted into the accommodation chamber 61 of the cartridge mounting portion 6, the cartridge 4 is supported from a −Z direction side by a support member 610 of the cartridge mounting portion 6. In addition, in the mounted state in which the cartridge 4 is mounted in the accommodation chamber 61 of the cartridge mounting portion 6, a liquid supply portion 442 of the cartridge 4 and a liquid introduction portion 642 of the cartridge mounting portion 6 are coupled to each other. As a result, the ink contained in a liquid containing portion 450 of the cartridge 4 is supplied to the liquid introduction portion 642 via the liquid supply portion 442. In addition, in the present embodiment, the ink is supplied from the liquid supply portion 442 to the liquid introduction portion 642, while air contained in the liquid storage portion 699 becomes air bubbles and flows through the liquid introduction portion 642 and the liquid supply portion 442 to flow to the liquid containing portion 450. As a result, air-liquid exchange of the liquid containing portion 450 is performed. Note that in another embodiment, the cartridge 4 may have an atmospheric communication path communicating the liquid containing portion 450 with the outside, and air-liquid exchange may be performed through the atmospheric communication path. The atmospheric communication path is arranged at a position different from that of the liquid supply portion 442, and is formed, for example, on a wall forming the liquid containing portion 450.

The liquid introduction portion 642 receives the liquid supplied from the cartridge 4. The liquid introduction portion 642 is a tubular member and has an internal flow path for making the liquid flow therein. The liquid introduction portion 642 has a base end 642*a* and a tip 642*b*. The tip 642*b* is formed with an opening communicating with an introduction portion flow path which is the internal flow path, and the ink of the liquid supply portion 442 flows to the introduction portion flow path through the opening. The base end 642*a* is coupled to the liquid storage portion 699, and makes the ink that has flowed through the introduction portion flow path flow to the liquid storage portion 699. The liquid storage portion 699 is positioned on a −Z direction side of the accommodation chamber 61. The liquid storage portion 699 communicates with the ejection head 22 via the tube 24 illustrated in FIG. 1. As described above, the liquid introduction portion 642 communicates with the ejection head 22 via the liquid storage portion 699 and the tube 24. A central axis CA1 of the liquid introduction portion 642 is parallel to a central axis CA2 of the liquid supply portion 442 in the mounted state, and is inclined with respect to the Z direction. That is, a direction along the central axis CA1, which is a direction in which the liquid introduction portion 642 extends, intersects the insertion direction of the cartridge 4. The central axis CA2 of the liquid supply portion 442 is a direction along a direction in which the liquid supply portion 442 extends.

As illustrated in FIG. 4, in the mounted state of the cartridge 4, a circuit board 50 of the cartridge 4 and a device side terminal portion 70 of the cartridge mounting portion 6 are electrically coupled to each other by coming into contact with each other. The device side terminal portion 70 is held by a holding mechanism 73. The device side terminal portion 70 includes a plurality of device side terminals 721, a terminal holding portion 750, and a connector 739.

The plurality of device side terminals 721 (nine device side terminals in the present embodiment) are provided. Each of the plurality of device side terminals 721 is a conductive metal plate member. The device side terminal 721 has a terminal rotation fulcrum Rp, and a portion in contact with a cartridge side terminal 521 of the circuit board 50, which is an end portion, can be elastically deformed using the terminal rotation fulcrum Rp as a fulcrum. A direction in which the portion is elastically deformed is a direction along the Y direction and the Z direction. The terminal holding portion 750 holds the plurality of device side terminals 721. The connector 739 is electrically coupled to the plurality of device side terminals 721. In addition, the connector 739 is electrically coupled to the control portion 31 of the printing device 10 by a wiring (not illustrated). As a result, the circuit board 50 and the control portion 31 can perform data communication therebetween.

The holding mechanism 73 includes an urging member 780 and an attaching member 782. The urging member 780 is formed of a coil spring. The urging member 780 is arranged inside the attaching member 782. In addition, the device side terminal portion 70 is attached to the attaching member 782. The urging member 780 is compressed in a state in which the insertion of the cartridge 4 into the cartridge mounting portion 6 has been completed. As a result, the urging member 780 applies an external force Fa in a direction toward a removal direction side of the cartridge 4, which is the first device wall 67 side, to the device side terminal portion 70 via the attaching member 782. Since the device side terminal portion 70 is pressed against the circuit board 50 by the external force Fa, contact between the device side terminal 721 and the cartridge side terminal 521 is maintained well.

As described above, the holding mechanism 73 holds the device side terminal portion 70 so as to be displaceable in a direction along the insertion direction of the cartridge 4. In addition, one end portion of the urging member 780 adjacent to the device side terminal portion 70 is configured to be slightly movable in the X direction and the Z direction intersecting the insertion direction. As a result, the device side terminal portion 70 is held by the holding mechanism 73 so as to be slightly movable in the X direction and the Z direction intersecting the insertion direction.

A mounting process of the cartridge 4 in the cartridge mounting portion 6 includes a terminal coupling process and a supply portion coupling process executed after the terminal coupling process. The terminal coupling process is a process of bringing and electrically coupling the device side terminal 721 and the cartridge side terminal 521 into contact with and to each other by moving the cartridge 4 in the −Y direction through the insertion/removal opening 674 of the first device wall 67 illustrated in FIG. 3 to insert the cartridge 4 into the accommodation chamber 61 of the cartridge mounting portion 6. The supply portion coupling process is a process of coupling the liquid introduction portion 642 and the liquid supply portion 442 to each other by rotationally moving a rear surface 47 side of the cartridge 4 in a coupling direction D2 indicated by an arrow, using a rotation fulcrum 698 serving as a displacement mechanism included in the support member 610 as a fulcrum in a state of maintaining the electrical coupling between the device side terminal 721 and the cartridge side terminal 521. The rotation fulcrum 698 is provided adjacent to a second device wall 62 of the cartridge mounting portion 6.

In the supply portion coupling process, a device side supply portion positioning portion 644, which is a projection included in the cartridge mounting portion 6, enters a supply portion positioning portion 448 included in the cartridge 4 and having a recessed shape, such that the movement of the liquid supply portion 442 in a direction intersecting the central axis CA2 of the liquid supply portion 442 is regulated. As a result, positioning of the liquid supply portion 442 with respect to the liquid introduction portion 642 is performed. The device side supply portion positioning portion 644 has a substantially rectangular parallelepiped shape. The device side supply portion positioning portion 644 has one end portion 644*a* and the other end portion 644*b*. The one end portion 644*a* is positioned adjacent to the liquid storage portion 699. The one end portion 644*a* is positioned more adjacent to the accommodation chamber 61 than the other end portion 644*b* is.

In the mounted state of the cartridge 4, a main wall 613 forming a bottom portion of the support member 610 is inclined with respect to the Y direction. Specifically, the main wall 613 of the support member 610 is inclined so as to be positioned on the −Z direction side, which is a lower side, toward the +Y direction. The main wall 613 is parallel to the Y direction in an initial arrangement state of the cartridge mounting portion 6 in which the cartridge 4 is not mounted.

The cartridge mounting portion 6 includes an urging member 625 that applies an external force Ft1 to the support member 610 in order to return the support member 610 to a position when in the initial arrangement state, in the mounted state of the cartridge 4. The urging member 625 is a coil spring provided between the support member 610 and the liquid storage portion 699, and is in a compressed state in the mounted state. The urging member 625 in the compressed state applies the external force Ft1 having a +Z direction component to the support member 610. Meanwhile, in the mounted state of the cartridge 4, a cartridge engaging portion 497 of the cartridge 4 engages with a mounting engaging portion 697 of the cartridge mounting portion 6, such that the mounted state is maintained. The mounting engaging portion 697 is formed on an engagement forming body 677 of the cartridge mounting portion 6.

Figure 5:
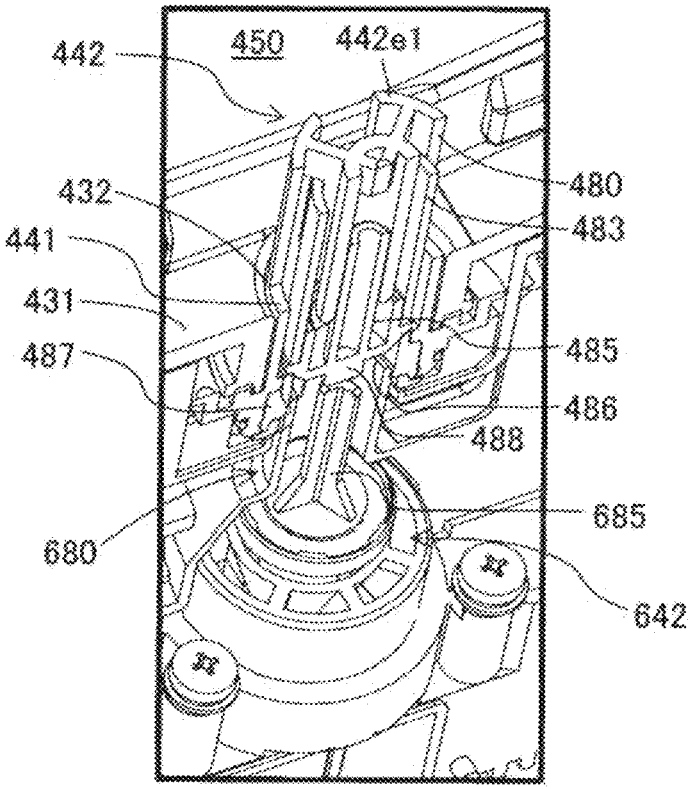
FIG. 5 is a schematic partially cut-away view illustrating a region including a liquid supply portion and a liquid introduction portion.
Figure 6:
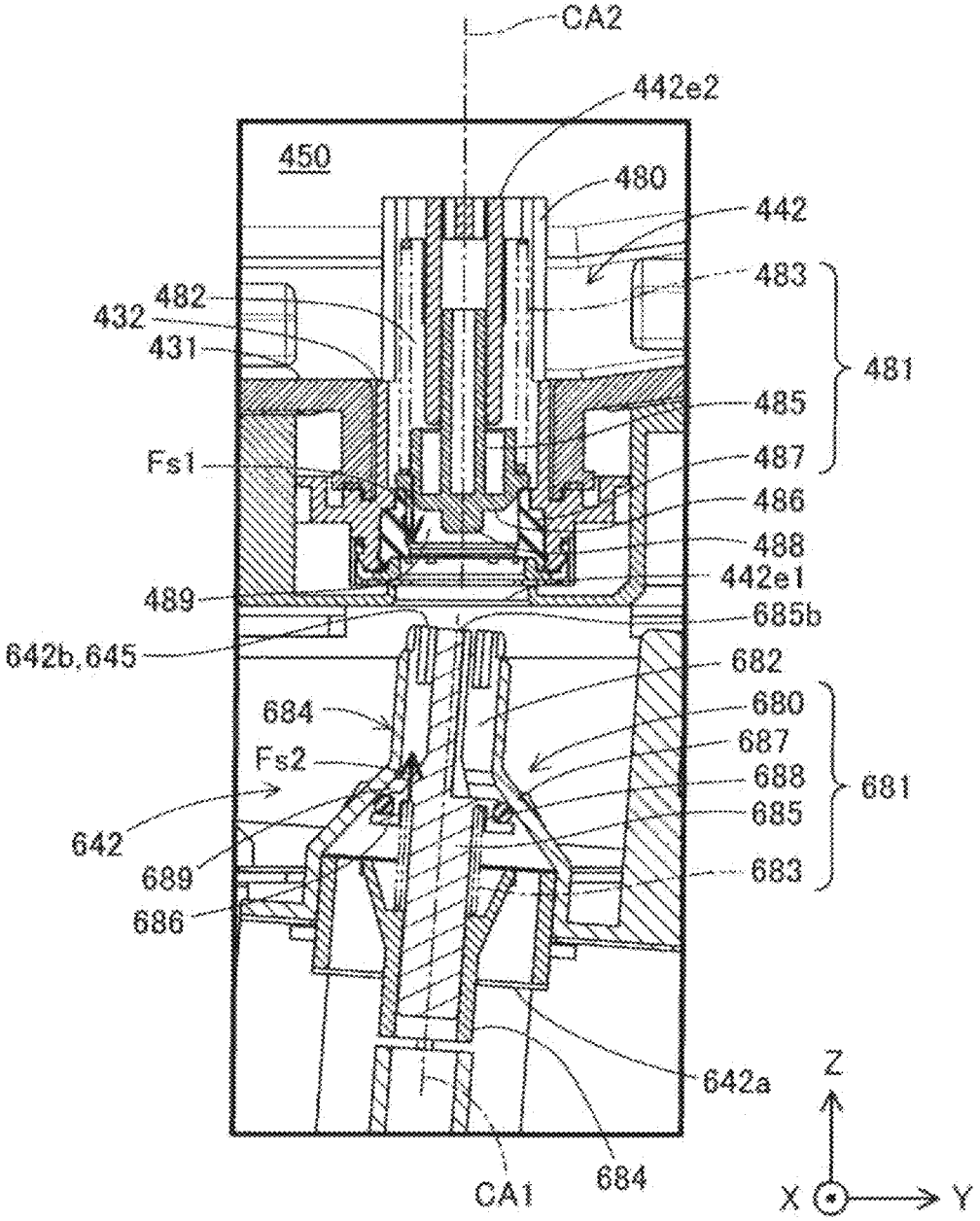
FIG. 6 is a sectional view illustrating the region including the liquid supply portion and the liquid introduction portion at a point in time at which a terminal coupling process ends.
Figure 7:
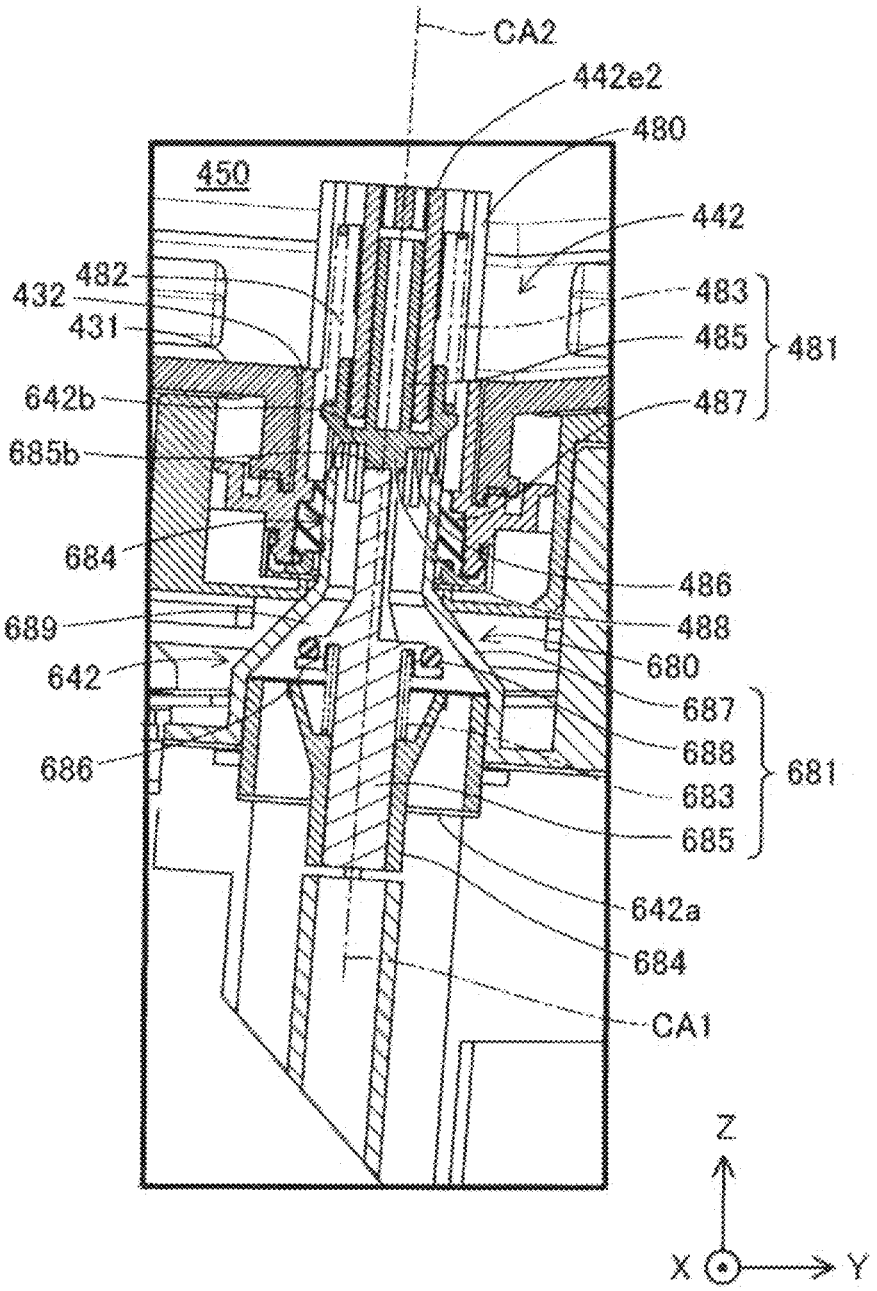
FIG. 7 is a sectional view illustrating the region including the liquid supply portion and the liquid introduction portion at a point in time at which a supply portion coupling process ends.

A-3. Detailed Configuration of Liquid Supply Portion and Liquid Introduction Portion FIG. 5 is a schematic partially cut-away view illustrating a region including the liquid supply portion 442 and the liquid introduction portion 642 in the mounted state. FIG. 6 is a sectional view illustrating the region including the liquid supply portion 442 and the liquid introduction portion 642 at a point in time at which the terminal coupling process ends. FIG. 7 is a sectional view illustrating the region including the liquid supply portion 442 and the liquid introduction portion 642 at a point in time at which the supply portion coupling process ends.

As illustrated in FIG. 7, the liquid supply portion 442 is coupled to the liquid introduction portion 642 and makes the liquid of the liquid containing portion 450 flow to the liquid introduction portion 642, that is, to the outside. The liquid supply portion 442 communicates with the liquid containing portion 450. In addition, as illustrated in FIG. 6, the liquid supply portion 442 has the central axis CA2. A direction along the central axis CA2 is the Z direction when the terminal coupling process in which the cartridge 4 is inserted into the cartridge mounting portion 6 is completed. The direction along the central axis CA2, which is the direction in which the liquid supply portion 442 extends, intersects the −Y direction, which is the insertion direction D1. The liquid supply portion 442 has a supply opening 442*e*1 formed at a tip, and a supply base end portion 442*e*2 forming a base end. The supply base end portion 442*e*2 is positioned in the liquid containing portion 450. The supply opening 442*e*1 is open toward the outside.

The liquid supply portion 442 includes a flow path main body 480 and a cartridge side valve mechanism 481. The flow path main body 480 is inserted into a flow opening 432 formed in a container bottom wall 431 which is a bottom wall of the liquid containing portion 450. A supply portion flow path 482 is formed in the flow path main body 480. As illustrated in FIG. 5, a plurality of slits 441 are formed at intervals in a circumferential direction in a portion of a side wall of the flow path main body 480 that is positioned adjacent to the flow opening 432 in the liquid containing portion 450 and the supply base end portion 442*e*2. The liquid of the liquid containing portion 450 flows to the supply portion flow path 482 through the slits 441. Note that a portion of the side wall of the flow path main body 480 that is positioned between the flow opening 432 and the supply opening 442*e*1 forms a tubular member without a slit.

As illustrated in FIG. 6, the cartridge side valve mechanism 481 is arranged in the supply portion flow path 482, and opens/closes the supply portion flow path 482. The cartridge side valve mechanism 481 includes a cartridge side valve seat 487, a cartridge side valve body 485, and a cartridge side urging member 483. The cartridge side valve seat 487, the cartridge side valve body 485, and the cartridge side urging member 483 are sequentially arranged from the supply opening 442*e*1 side in the direction along the central axis CA2.

The cartridge side valve seat 487 is arranged in the vicinity of the supply opening 442*e*1. The cartridge side valve seat 487 is a ring-shaped member. The cartridge side valve seat 487 is formed by an elastic member such as a synthetic rubber or an elastomer. An outer circumferential surface of the cartridge side valve seat 487 is air-tightly attached to an inner circumferential surface of the flow path main body 480. A cartridge side valve hole 489 penetrating in the direction along the central axis CA2 is formed in the cartridge side valve seat 487.

A tip side portion of the cartridge side valve body 485 abuts on the cartridge side valve seat 487 and stops the cartridge side valve hole 489 in a state in which the liquid introduction portion 642 is not coupled to the liquid supply portion 442. On the other hand, the cartridge side valve body 485 is opened by being separated from the cartridge side valve seat 487 in the mounted state of the cartridge 4 in which the liquid introduction portion 642 is coupled to the liquid supply portion 442. That is, the cartridge side valve body 485 is displaced in the direction along the central axis CA2 to open/close the supply portion flow path 482. The cartridge side valve body 485 is a rod-shaped member extending in the direction along the central axis CA2.

The cartridge side valve body 485 has a tip surface 486 positioned adjacent to the supply opening 442*e*1. The tip surface 486 faces the supply opening 442*e*1. In addition, the cartridge side valve body 485 has a protrusion 488 protruding from the tip surface 486 toward the supply opening 442*e*1. The protrusion 488 has a cylindrical shape. Note that in another embodiment, the protrusion 488 may have a prism shape whose cross section has a polygonal shape such as a quadrangular shape or pentagonal shape. The protrusion 488 is arranged at a position passing the central axis CA2. The protrusion 488 is positioned in the cartridge side valve hole 489 of the cartridge side valve seat 487 when the cartridge side valve mechanism 481 is in a closed state. As illustrated in FIG. 7, the protrusion 488 of the cartridge side valve body 485 presses a device side valve body 685 arranged in the liquid introduction portion 642 in the supply portion coupling process to open the device side valve body 685.

As illustrated in FIG. 6, the cartridge side urging member 483 urges the cartridge side valve body 485 in a direction toward the cartridge side valve seat 487. The cartridge side urging member 483 is, for example, a compressed coil spring. One end of the cartridge side urging member 483 abuts on the cartridge side valve body 485, and the other end of the cartridge side urging member 483 abuts on the flow path main body 480. In a state before the coupling between the liquid introduction portion 642 and the liquid supply portion 442 is started, that is, when the cartridge side valve mechanism 481 is in the closed state, an urging force of the cartridge side urging member 483 with respect to the cartridge side valve body 485 is a first urging force Fs1.

In the mounted state of the cartridge 4, the liquid introduction portion 642 is coupled to the liquid supply portion 442 and receives the liquid from the liquid supply portion 442. The liquid introduction portion 642 has an introduction portion flow path 682 through which the liquid supplied from the liquid supply portion 442 flows. In addition, the liquid introduction portion 642 has the central axis CA1. The central axis CA1 is inclined with respect to the gravity direction. In the present embodiment, the central axis CA1 is inclined by 5° with respect to the gravity direction.

The liquid introduction portion 642 includes an introduction portion main body 680 whose cross section has a ring shape, and a device side valve mechanism 681. The introduction portion flow path 682 is formed in the introduction portion main body 680. The introduction portion main body 680 forms the tip 642*b* of the liquid introduction portion 642. The tip 642*b* forms an upstream end of the introduction portion flow path 682 in a direction in which the liquid flows from the liquid supply portion 442 to the liquid introduction portion 642. The tip 642*b* has an introduction portion opening 645 forming the upstream end of the introduction portion flow path 682.

As illustrated in FIG. 6, the device side valve mechanism 681 is arranged in the introduction portion flow path 682, and opens/closes the introduction portion flow path 682. The device side valve mechanism 681 includes a device side valve seat 687 formed by the introduction portion main body 680, the device side valve body 685, and a device side urging member 683.

The device side valve seat 687 is a portion of the introduction portion main body 680 that is inclined with respect to the central axis CA1. In the present embodiment, the device side valve seat 687 is a portion of the introduction portion main body 680, of which an inner diameter increases from the tip 642*b* side toward the base end 642*a* side. The device side valve seat 687 has a device side valve hole 689 which is a part of the introduction portion flow path 682. Note that the device side valve seat 687 is not limited thereto, and in another embodiment, the introduction portion main body 680 may have a portion whose diameter increases in a direction orthogonal to the central axis CA1, and the device side valve seat 687 may be formed by the portion with the increasing diameter.

The device side valve body 685 is a rod-shaped member extending in the direction along the central axis CA1. The device side valve body 685 is positioned in the introduction portion flow path 682, and opens/closes the introduction portion flow path 682. The device side valve body 685 is arranged at a position at which the device side valve body 685 is opened by being pushed by the protrusion 488 of the cartridge side valve body 485. Specifically, a tip 685*b* of the device side valve body 685 pushed by the protrusion 488 is positioned on a trajectory along which the protrusion 488 moves in the supply portion coupling process. In the present embodiment, the tip 685*b* is arranged at a position passing the central axis CA1. As described above, the device side valve body 685 is arranged at the position at which the device side valve body 685 is opened by being pushed by the protrusion 488, such that it is possible to easily open the device side valve body 685 by using the protrusion 488.

The device side valve body 685 is positioned in the introduction portion flow path 682 without protruding from the introduction portion opening 645, regardless of an opened state or a closed state. In the present embodiment, the tip 685*b* of the device side valve body 685 is positioned at the same height position as that of the introduction portion opening 645 when in the closed state. Further, the tip 685*b* of the device side valve body 685 is positioned on the base end 642*a* side, which is a side deeper than the introduction portion opening 645, when in the opened state. As a result, it is possible to reduce a possibility that the liquid attached to the device side valve body 685 will leak to the outside. Further, since the tip 685*b* of the device side valve body 685 does not protrude from the introduction portion opening 645, it is possible to reduce a possibility that the device side valve body 685 will be unintentionally opened due to a collision between the device side valve body 685 and another object or the like in a state in which the cartridge 4 is not mounted. In addition, since the tip 685*b* of the device side valve body 685 does not protrude from the introduction portion opening 645, it is possible to reduce a possibility that the cartridge 4 will collide with a portion other than the device side valve body 685 in the mounting process of the cartridge 4.

The device side valve body 685 includes an arrangement portion 686 and a seal member 688 which is a ring-shaped elastic member. The arrangement portion 686 is a portion of a main body of the device side valve body 685, of which a size in a direction orthogonal to the central axis CA1 is larger than that of other portions. The arrangement portion 686 faces the device side valve seat 687. The seal member 688 is formed of an elastomer or a rubber. The seal member 688 is attached to the arrangement portion 686 of the device side valve body 685, and interlocked to the main body of the device side valve body 685. In a state in which the liquid introduction portion 642 and the liquid supply portion 442 are not coupled to each other, the seal member 688 air-tightly abuts on the device side valve seat 687, such that the device side valve hole 689 of the device side valve seat 687 is stopped by the device side valve body 685. As a result, the device side valve body 685 is closed. On the other hand, the device side valve body 685 is closed by being separated from the device side valve seat 687 of the introduction portion main body 680 in the mounted state of the cartridge 4 in which the liquid introduction portion 642 is coupled to the liquid supply portion 442. Specifically, as illustrated in FIG. 7, as the protrusion 488 of the cartridge side valve body 485 pushes the device side valve body 685, the device side valve body 685 is displaced in a direction away from the device side valve seat 687 and is thus opened. That is, the device side valve body 685 is displaced in the direction along the central axis CA1 to open/close the introduction portion flow path 682.

The device side urging member 683 urges the device side valve body 685 in a direction toward the device side valve seat 687. The device side urging member 683 is, for example, a compressed coil spring. One end of the device side urging member 683 abuts on the arrangement portion 686, and the other end of the device side urging member 683 abuts on a pedestal 684. The pedestal 684 is a member forming the base end 642*a* of the liquid introduction portion 642, and is attached to the introduction portion main body 680. In a state before the coupling between the liquid introduction portion 642 and the liquid supply portion 442 is started, that is, when the device side valve mechanism 681 is in the closed state, an urging force of the device side urging member 683 with respect to the device side valve body 685 is a second urging force Fs2.

As the rear surface 47 side of the cartridge 4 is rotationally moved in the coupling direction D2 as illustrated in FIG. 3 in a state in which the terminal coupling process illustrated in FIG. 6 has been completed, the rear surface 47 side of the cartridge 4 is moved downward. As a result, the liquid supply portion 442 is moved downward along a rotation trajectory around the rotation fulcrum 698, such that the liquid introduction portion 642 and the liquid supply portion 442 are coupled to each other as illustrated in FIG. 7. In the supply portion coupling process between a state in which the terminal coupling process illustrated in FIG. 6 has been completed and a state in which the coupling between the liquid supply portion 442 and the liquid introduction portion 642 illustrated in FIG. 7 has been completed, the cartridge side valve mechanism 481 and the device side valve mechanism 681 have a first open/close relationship as described below. That is, in the supply portion coupling process in which the liquid introduction portion 642 and the liquid supply portion 442 are coupled to each other, the device side valve body 685 is opened earlier than the cartridge side valve body 485. In the present embodiment, as the first urging force Fs1 is set to be larger than the second urging force Fs2, the above-described first open/close relationship is established. The magnitude of the urging force can be set according to a material or a degree of compression of the compressed coil spring. In the present embodiment, a diameter of the cartridge side urging member 483, which is a compressed coil spring, is larger than a diameter of the device side urging member 683, which is a compressed coil spring, such that the first urging force Fs1 is set to be larger than the second urging force Fs2.

As described above, a magnitude relationship between the first urging force Fs1 and the second urging force Fs2 is set, such that it is possible to easily perform setting so that the device side valve body 685 is opened earlier than the cartridge side valve body 485.

In the supply portion coupling process, the protrusion 488 of the cartridge side valve body 485 abuts on the tip 685*b* of the device side valve body 685. In addition, the cartridge 4 is rotationally moved in the coupling direction D2, such that the liquid supply portion 442 is moved downward along the rotation trajectory. As a result, the protrusion 488 pushes the device side valve body 685 toward the base end 642*a* (that is, in a direction away from the device side valve seat 687) against the urging force of the device side urging member 683. As the device side valve body 685 is pushed, the seal member 688 of the device side valve body 685 is separated from the device side valve seat 687. As a result, the device side valve body 685 is opened. As the device side valve body 685 is opened, the introduction portion flow path 682 is opened. The supply portion coupling process further proceeds, and the cartridge 4 is further rotationally moved in the coupling direction D2, such that the cartridge side valve body 485 is pushed against the urging force of the cartridge side urging member 483 by a reaction force from the device side valve body 685. As a result, the cartridge side valve body 485 is separated from the cartridge side valve seat 487, such that the cartridge side valve body 485 is opened. As the cartridge side valve body 485 is opened, the supply portion flow path 482 is opened.

As described above, in the supply portion coupling process, it is possible to easily open the device side valve body 685 of the liquid introduction portion 642 by using the protrusion 488 of the cartridge side valve body 485. Further, since the protrusion 488 has a cylindrical shape or a prism shape, the protrusion 488 can be formed in a simple shape. In addition, when the liquid is attached to the protrusion 488, since the protrusion 488 comes into contact with the tip 685*b* of the device side valve body 685, the attached liquid can be moved to the device side valve body 685 side. As a result, it is possible to reduce a possibility that the liquid will leak from the liquid supply portion 442 to the outside after the cartridge 4 is removed from the cartridge mounting portion 6. Further, in the supply portion coupling process, the device side valve body 685 is opened earlier than the cartridge side valve body 485, such that the introduction portion flow path 682 is opened. Therefore, it is possible to reduce a possibility that air will remain between the device side valve body 685 and the cartridge side valve body 485. Accordingly, it is possible to suppress the remaining air from being compressed in the supply portion coupling process, such that it is possible to suppress an external force, which is to be applied to the cartridge 4 in order to couple the liquid supply portion 442 and the liquid introduction portion 642 to each other, from being excessively large. Therefore, the user can smoothly mount the cartridge 4 in the cartridge mounting portion 6.

Further, in the decoupling process in which the liquid introduction portion 642 and the liquid supply portion 442 are decoupled from each other, the rear wall 47 side of the cartridge 4 is lifted to rotationally move the cartridge 4 in the decoupling direction D3, which is a direction opposite to the coupling direction D2, as illustrated in FIG. 3. As a result, the liquid supply portion 442 is separated and decoupled from the liquid introduction portion 642. In the decoupling process, the cartridge side valve mechanism 481 and the device side valve mechanism 681 have a second open/close relationship as described below. That is, in the decoupling process, the cartridge side valve body 485 is closed earlier than the device side valve body 685. In other words, in the decoupling process, as the liquid supply portion 442 of the cartridge 4 is separated from the liquid introduction portion 642, the cartridge side valve body 485 is moved close to the cartridge side valve seat 487 and abuts on the cartridge side valve seat 487. Meanwhile, the device side valve body 685 is separated from the device side valve seat 687 without abutting on the device side valve seat 687 until the cartridge side valve body 485 abuts on the cartridge side valve seat 487. When the decoupling process further proceeds, the device side valve body 685 is moved close to the device side valve seat 687 and abuts on the device side valve seat 687.

As described above, in the decoupling process, the cartridge side valve body 485 is closed earlier than the device side valve body 685, such that the liquid remaining in the liquid supply portion 442 can be made to flow to the liquid introduction portion 642 of which the device side valve body 685 is open. As a result, it is possible to reduce a possibility that the liquid will leak from the liquid supply portion 442 to the outside in the decoupling process.

A-4. Detailed Configuration of Cartridge Mounting Portion 6

Figure 8:
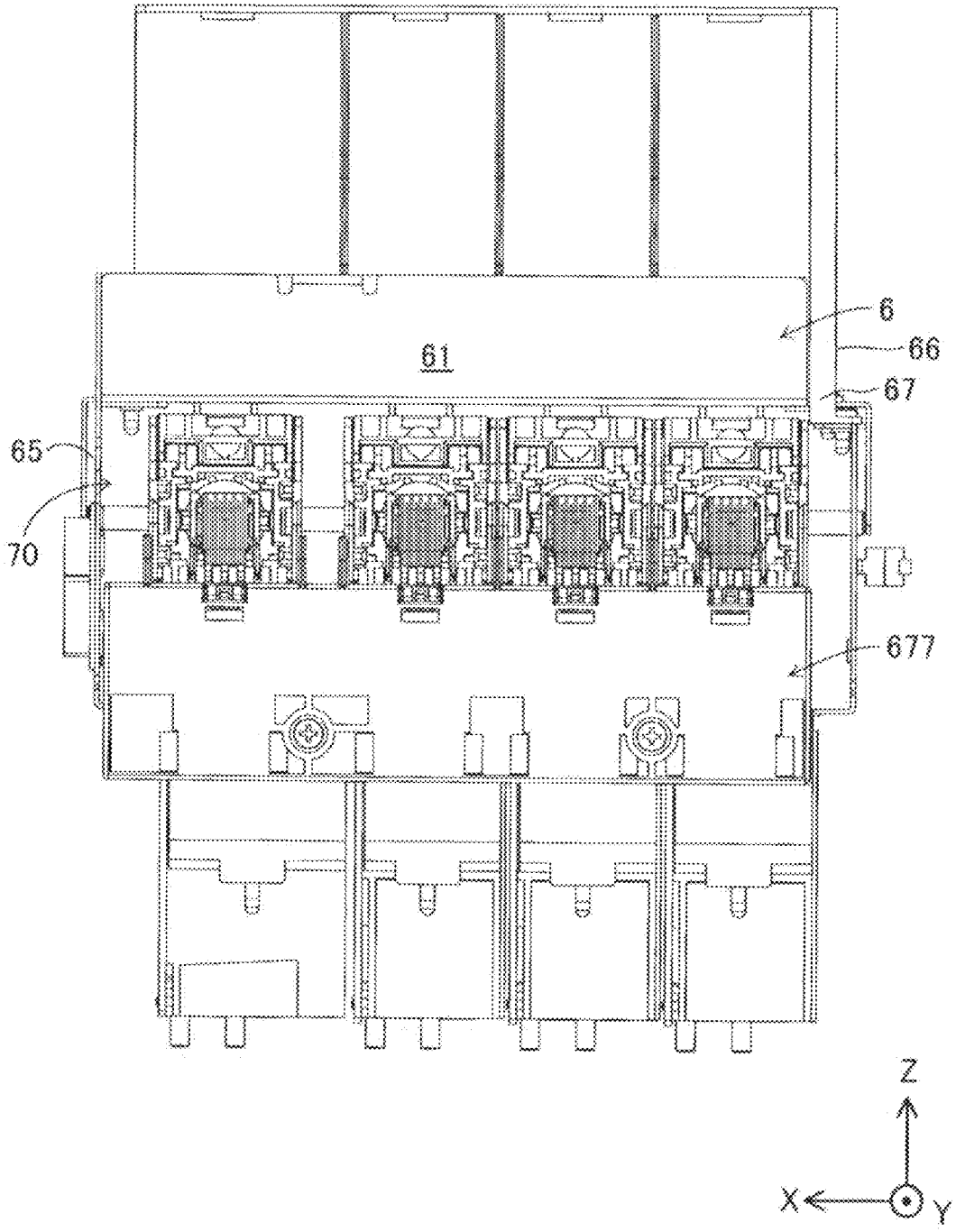
FIG. 8 is a view of the cartridge mounting portion when viewed from a +Y direction side.
Figure 9:
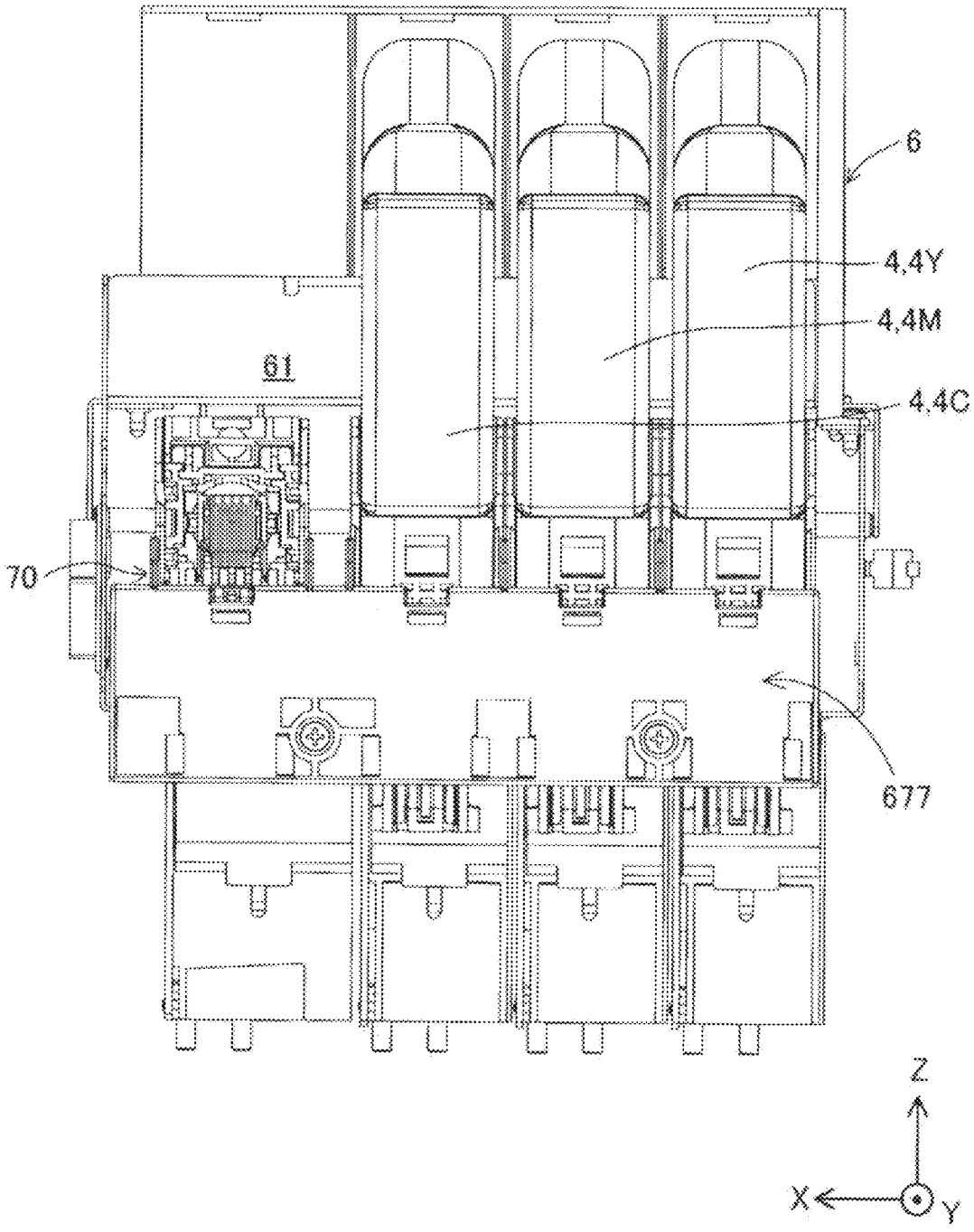
FIG. 9 is a view illustrating that a cartridge is mounted in the cartridge mounting portion.
Figure 10:
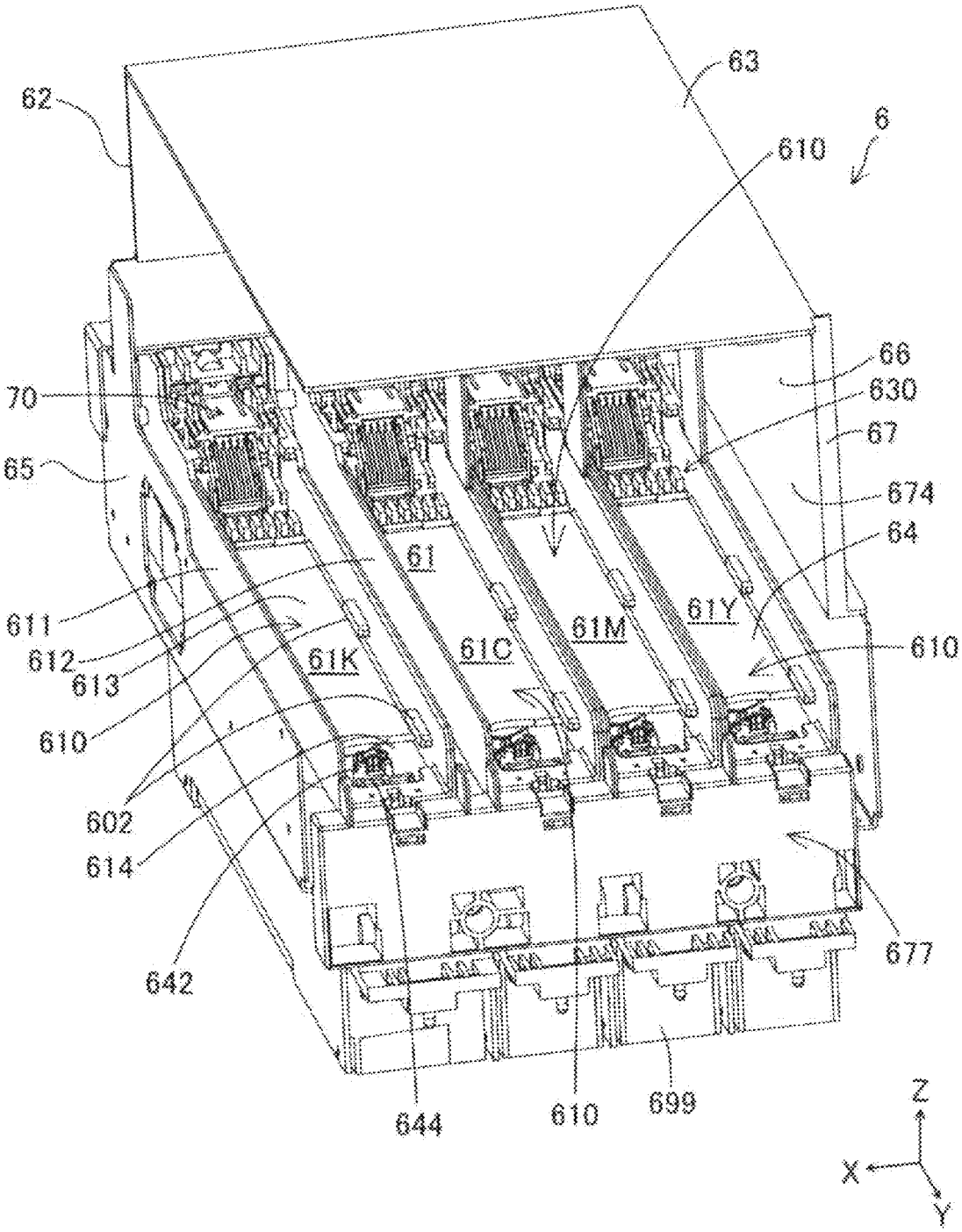
FIG. 10 is a perspective view of the cartridge mounting portion.
Figure 11:
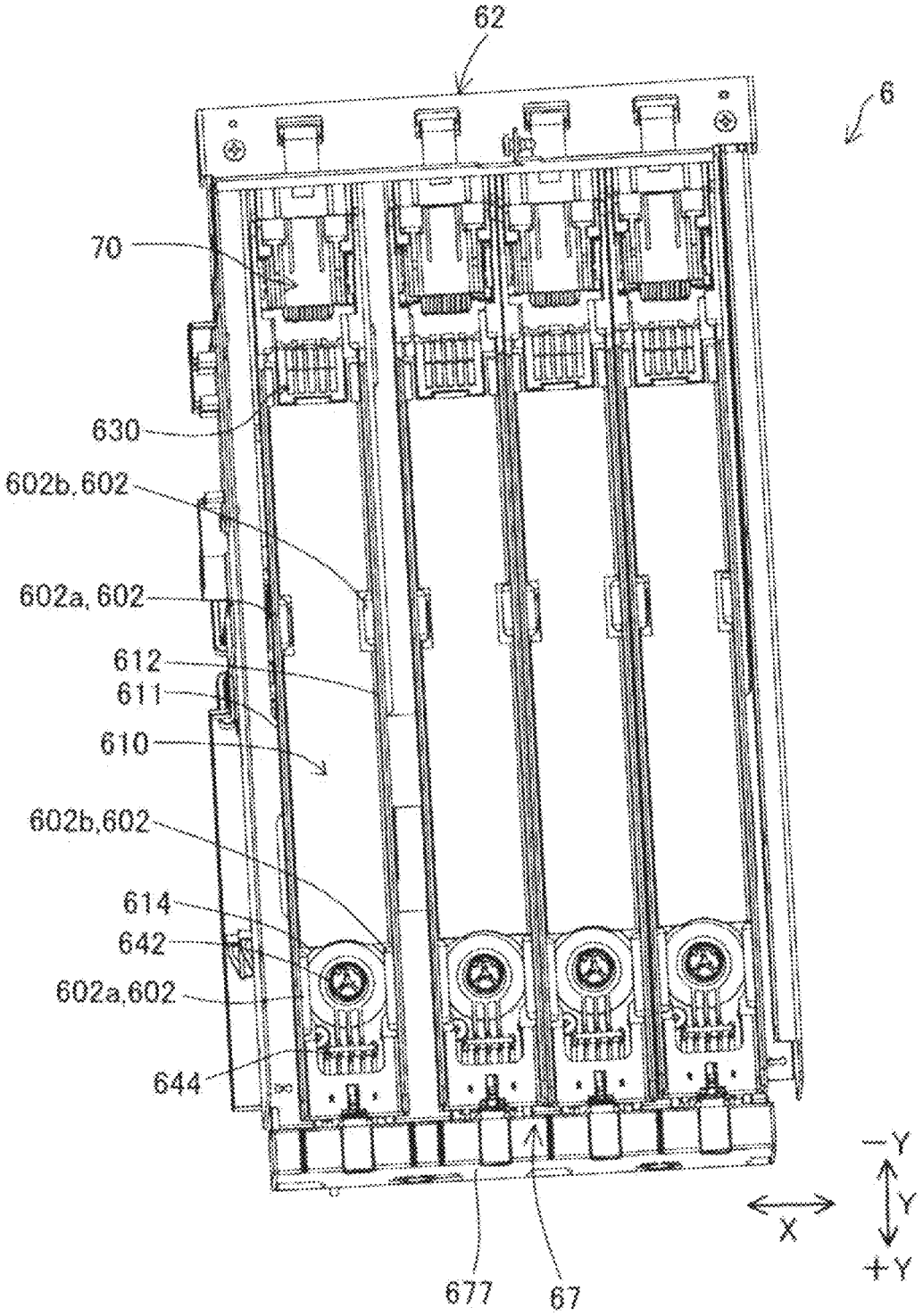
FIG. 11 is a view of the cartridge mounting portion when viewed from a +Z direction side.
Figure 12:
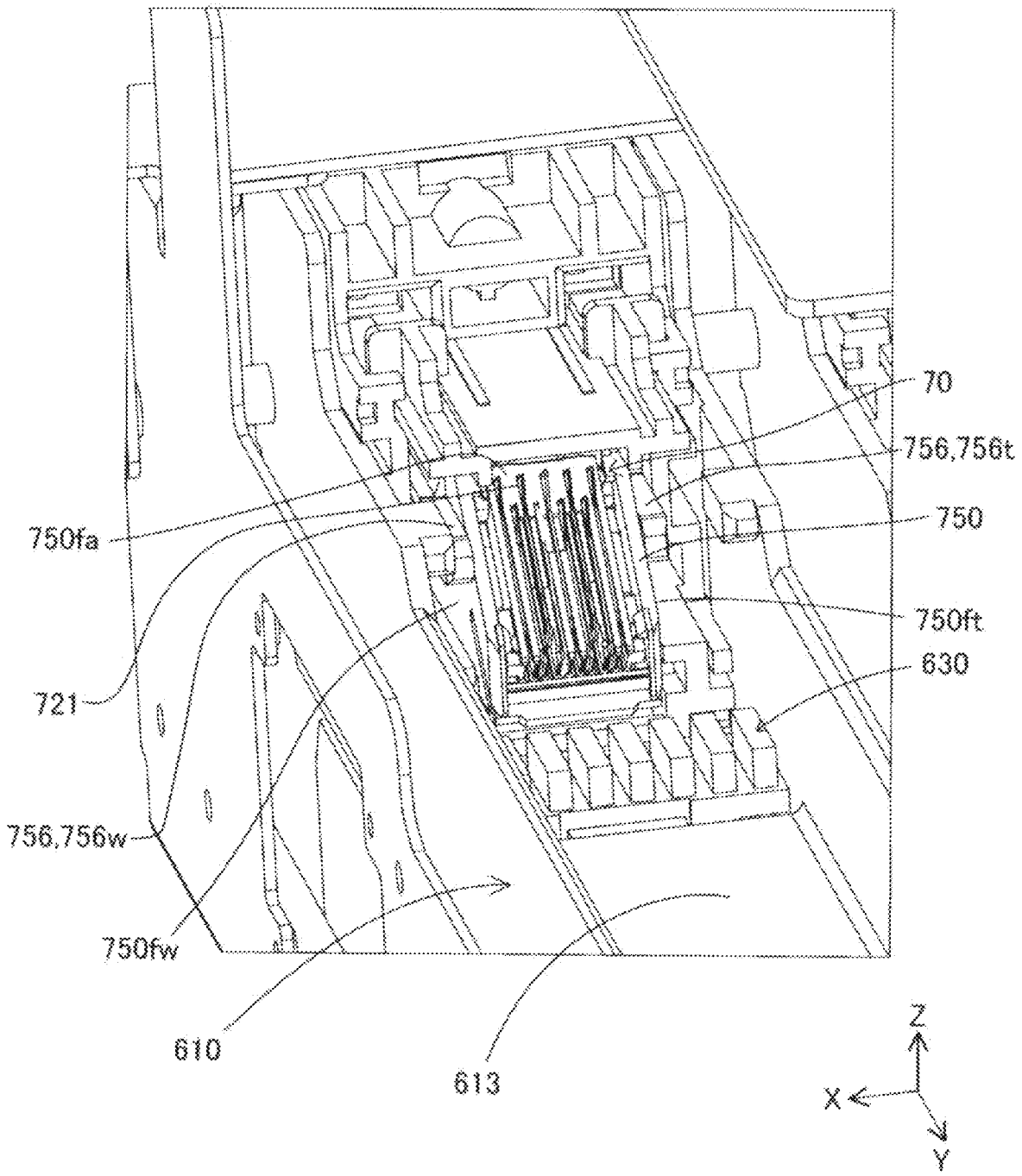
FIG. 12 is a partially enlarged view of the cartridge mounting portion.
Figure 13:
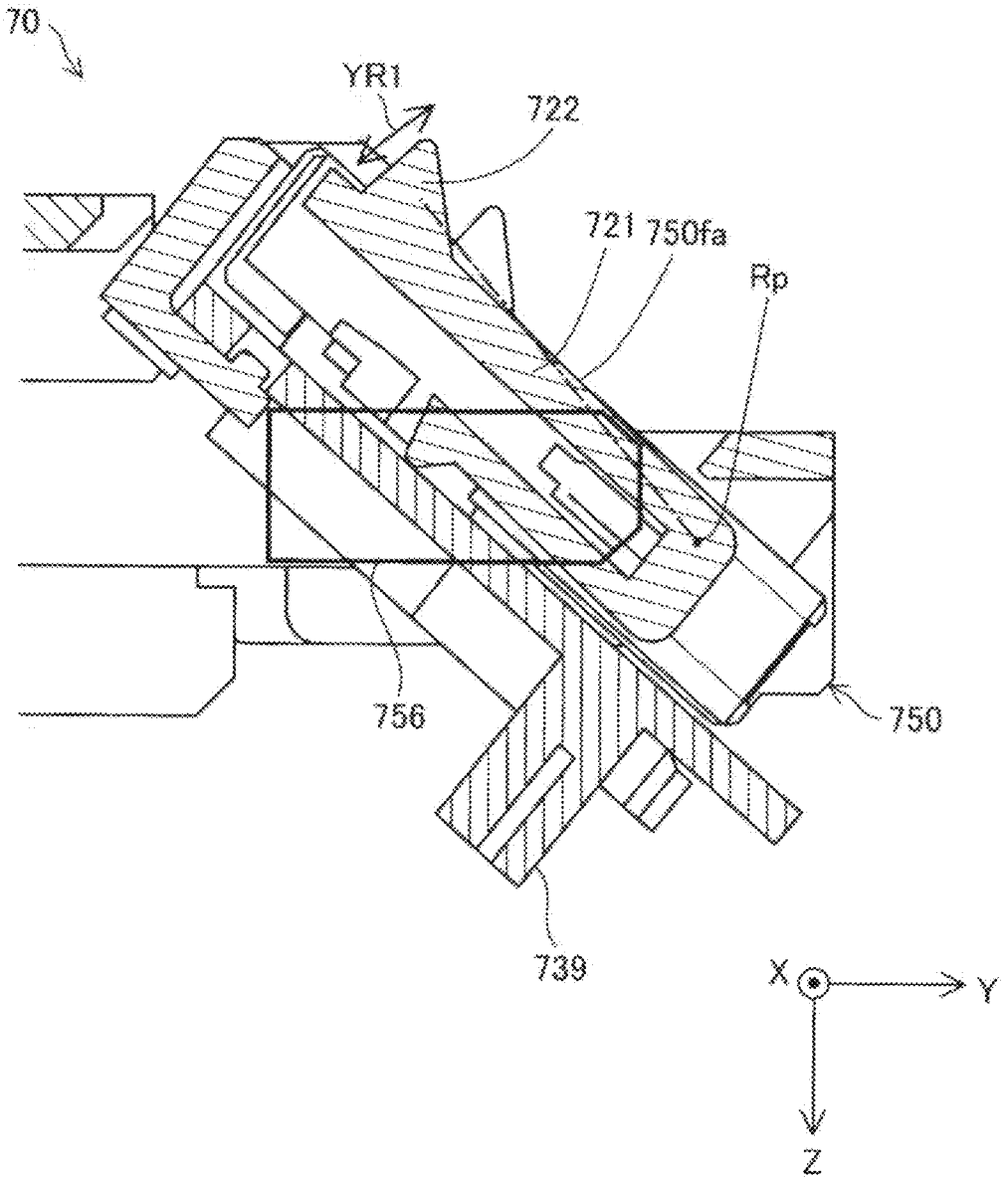
FIG. 13 is a schematic sectional view of a device side terminal portion.

FIG. 8 is a view of the cartridge mounting portion 6 when viewed from the +Y direction side. FIG. 9 is a view illustrating that the cartridge 4 is mounted in the cartridge mounting portion 6. FIG. 10 is a perspective view of the cartridge mounting portion 6. FIG. 11 is a view of the cartridge mounting portion 6 when viewed from the +Z direction side. FIG. 12 is a partially enlarged view of the cartridge mounting portion 6. FIG. 13 is a schematic sectional view of the device side terminal portion 70. In FIGS. 9 to 13, some of components of the cartridge mounting portion 6 are not illustrated in order to facilitate understanding. Regarding the cartridge mounting portion 6, the X direction is also referred to as a width direction, the Y direction is also referred to as a depth direction, and the Z direction is also referred to as a height direction. In the following, unless there is a particular description about a state, each element will be described on the premise of the cartridge mounting portion 6 in the initial arrangement state in which the cartridge 4 is not mounted in the cartridge mounting portion 6.

As illustrated in FIGS. 8 to 10, in the cartridge mounting portion 6, the accommodation chamber 61 in which the cartridge 4 is accommodated is formed. The accommodation chamber 61 has a substantially rectangular parallelepiped shape. Slots 61C, 61M, 61Y, and 61K, which are portions of the accommodation chamber 61 for accommodating the respective cartridges 4C, 4M, 4Y, and 4K, generally correspond to appearance shapes of the respective cartridges 4C, 4M, 4Y, and 4K. In the present embodiment, the cartridge 4K has a greater dimension in the Y direction than the other cartridges 4C, 4M, and 4Y in order to contain a larger amount of liquid. Therefore, in the present embodiment, a width of the slot 61K is greater than that of the other slots 61C, 61M, and 61Y.

As illustrated in FIG. 10, the cartridge mounting portion 6 has six device walls 62, 63, 64, 65, 66, and 67 forming the accommodation chamber 61. In the present disclosure, the term "wall" is a concept including a wall composed of a plurality of walls in addition to a single wall. The second device wall 62 forms a wall of the accommodation chamber 61 on the −Y direction side. The second device wall 62 is a substantially vertical wall in a use state of the printing device 10.

The first device wall 67 faces the second device wall 62 in the Y direction. In the first device wall 67, the insertion/removal opening 674 through which the cartridge 4 passes when it is inserted into or removed from the accommodation chamber 61 is formed.

A device top wall 63 forms a wall of the accommodation chamber 61 on the +Z direction side. A device bottom wall 64 faces the device top wall 63 in the Z direction, and forms a wall of the accommodation chamber 61 on the −Z direction side. The device bottom wall 64 is formed by the support member 610. The device bottom wall 64 has a plurality of openings 614. In the present embodiment, four openings 614 are formed corresponding to the slots 61C, 61M, 61Y, and 61K. The device top wall 63 and the device bottom wall 64 intersect the second device wall 62 and the first device wall 67. In the present disclosure, the term "cross" or "intersect" means any one of (i) a state in which two elements intersect or actually cross each other, (ii) a state in which one element crosses the other element when one element has extended, and (iii) a state in which mutual elements intersect each other when the mutual elements have extended.

A first device side wall 65 forms a wall of the accommodation chamber 61 on the +X direction side. A second device side wall 66 faces the first device side wall 65 in the X direction, and forms a wall of the accommodation chamber 61 on the −X direction side. The first device side wall 65 and the second device side wall 66 intersect the second device wall 62, the first device wall 67, the device top wall 63, and the device bottom wall 64.

As illustrated in FIGS. 10 and 11, the cartridge mounting portion 6 further includes the support member 610, the liquid introduction portion 642, the supply portion positioning portion 644, device guide portions 602, and the engagement forming body 677. A plurality of support members 610 are provided according to the number of cartridges 4 to be mounted. In the present embodiment, four support members 610 are provided. The support member 610 forms the device bottom wall 64 of the accommodation chamber 61 on a gravity direction side. The support member 610 supports the cartridge 4 from the −Z direction side, which is the gravity direction side. The support member 610 is a member extending along the Y direction. The support member 610 has a recessed shape. The support member 610 has a main wall 613 forming the device bottom wall 64, a first support side wall 611, and a second support side wall 612.

The main wall 613 forms a bottom portion positioned on the gravity direction side and having a recessed shape. The openings 614 are formed at an end portion of the main wall 613 adjacent to the first device wall 67. The openings 614 penetrate through the main wall 613 in a thickness direction of the main wall 613.

As illustrated in FIG. 10, the first support side wall 611 rises from a +X direction side end portion of the main wall 613 in the +Z direction, which is the antigravity direction. The second support side wall 612 rises from a −X direction side end portion of the main wall 613 in the +Z direction. The first support side wall 611 and the second support side wall 612 face each other in the X direction.

The device guide portions 602 guide the cartridge 4 in the insertion direction and a removal direction. The device guide portion 602 is provided for each support member 610. The device guide portions 602 are provided on each of the first support side wall 611 and the second support side wall 612. The device guide portions 602 are projections provided on the first support side wall 611 and the second support side wall 612. As illustrated in FIG. 11, a first device guide portion 602*a* provided on the first support side wall 611 is a projection protruding from the first support side wall 611 toward the second support side wall 612. The first device guide portion 602*a* extends along the Y direction. In addition, a plurality of first device guide portions 602*a* are arranged at intervals in the Y direction. A second device guide portion 602*b* provided on the second support side wall 612 is a projection protruding from the second support side wall 612 toward the first support side wall 611. The second device guide portion 602*b* extends along the Y direction. In addition, a plurality of second device guide portions 602*b* are arranged at intervals in the Y direction.

As illustrated in FIGS. 10 and 11, the liquid introduction portion 642 receives the liquid of the cartridge 4. In the initial arrangement state of the cartridge mounting portion 6, the liquid introduction portion 642 is not positioned in the accommodation chamber 61, but is positioned on the −Z direction side with respect to the accommodation chamber 61. That is, the liquid introduction portion 642 is positioned opposite to the support member 610 with the accommodation chamber 61 interposed therebetween. As a result, when the cartridge 4 is inserted into the accommodation chamber 61 of the cartridge mounting portion 6, it is possible to prevent the cartridge 4 from colliding with the liquid introduction portion 642. As described above, as illustrated in FIG. 3, the tip 642*b* of the liquid introduction portion 642 is arranged in the accommodation chamber 61 by rotationally moving the support member 610 around the rotation fulcrum 698 in the coupling direction D2 to push down the openings 614. That is, the rotation fulcrum 698 as the displacement mechanism arranges in the accommodation chamber 61 the tip 642*b* of the liquid introduction portion 642 through the openings 614 by rotationally moving the support member 610 to displace the openings 614 toward the gravity direction side.

The device side supply portion positioning portion 644 illustrated in FIG. 10 is received by the supply portion positioning portion 448 to regulate the movement of the liquid supply portion 442 with respect to the liquid introduction portion 642. As a result, positioning of the liquid supply portion 442 is performed. In the initial arrangement state of the cartridge mounting portion 6, the device side supply portion positioning portion 644 is not positioned in the accommodation chamber 61, but is positioned on the −Z direction side with respect to the accommodation chamber 61. That is, the device side supply portion positioning portion 644 is positioned opposite to the support member 610 with the accommodation chamber 61 interposed therebetween. As a result, when the cartridge 4 is inserted into the accommodation chamber 61 of the cartridge mounting portion 6, it is possible to prevent the cartridge 4 from colliding with the device side supply portion positioning portion 644. The other end portion 644*b* of the device side supply portion positioning portion 644 is arranged in the accommodation chamber 61 by rotating the support member 610 around the rotation fulcrum 698 in the coupling direction D2 to push down the openings 614. That is, the rotation fulcrum 698 arranges the other end portion 644*b* of the device side supply portion positioning portion 644 in the accommodation chamber 61 through the openings 614 by rotating the support member 610 to displace the openings 614.

As illustrated in FIG. 11, the cartridge mounting portion 6 further includes the device side terminal portion 70 and a device side identification member 630. As illustrated in FIG. 12, the terminal holding portion 750 included in the device side terminal portion 70 includes a holding portion surface 750*fa* on which the device side terminal 721 is exposed, a first holding portion side wall 750*ft*, and a second holding portion side wall 750*fw*. The first holding portion side wall 750*ft* forms a side wall of the terminal holding portion 750 on the +X direction side. The second holding portion side wall 750*fw* forms a side wall of the terminal holding portion 750 on the −X direction side.

As illustrated in FIGS. 11 and 12, the device side identification members 630 are used to identify whether or not correct types of cartridges 4C, 4M, 4Y, and 4K have been inserted into the respective slots 61C, 61M, 61Y, and 61K of the accommodation chamber 61. The device side identification members 630 form different pattern shapes depending on colors of the liquids contained in the cartridges 4C, 4M, 4Y, and 4K. In FIG. 11, in the respective slots 61C, 61M, 61Y, and 61K, the device side identification members 630 have the same pattern shape for convenience. However, the device side identification members 630 actually have different pattern shapes. The device side identification member 630 is provided on the main wall 613 of the support member 610.

As illustrated in FIG. 12, the device side identification member 630 is formed by at least one rib. The pattern shape is determined by the number and positions of ribs. The cartridges 4 are also provided with cartridge side identification members formed by ribs. The cartridge side identification members form different pattern shapes depending on types of the cartridges 4, that is, the colors of the liquids contained in the cartridges. When correct types of cartridges 4 are inserted into the corresponding slots 61C to 61K, the device side identification members 630 and the cartridge side identification members are fitted into each other without colliding with each other. On the other hand, when wrong types of cartridges 4 are inserted into the slots 61C to 61K, the device side identification members 630 and the cartridge side identification members collide with each other, such that further insertion of the cartridges 4 is hindered. As a result, a possibility that the wrong types of cartridges 4 will be mounted in the respective slots 61C to 61K of the cartridge mounting portion 6 can be reduced.

As illustrated in FIG. 12, the device side terminal portion 70 includes a device side terminal positioning portion 756 in addition to the plurality of device side terminals 721, the terminal holding portion 750, and the connector 739 described above. The device side terminal positioning portion 756 is received by a terminal positioning portion of the cartridge 4 in an insertion process of the cartridge 4 into the accommodation chamber 61, such that movement of the device side terminal positioning portion 756 in the X and Y directions, which are directions intersecting the insertion direction, is regulated. As a result, positioning of the device side terminal 721 and the cartridge side terminal 521 in the directions intersecting the insertion direction is performed.

Two device side terminal positioning portions 756 are provided for each of the slots 61C to 61K. One of the two device side terminal positioning portions 756 is also referred to as a first device side terminal positioning portion 756*t*, and the other of the two device side terminal positioning portions 756 is also referred to as a second device side terminal positioning portion 756*w*. The first device side terminal positioning portion 756*t* and the second device side terminal positioning portion 756*w* are columnar members each extending along the Y direction. The first device side terminal positioning portion 756*t* is provided on the first holding portion side wall 750*ft*. The second device side terminal positioning portion 756*w* is provided on the second holding portion side wall 750*fw*.

As illustrated in FIG. 13, the holding portion surface 750*fa* of the terminal holding portion 750 is inclined with respect to the Y direction and the Z direction toward a direction including a +Y direction component and a +Z direction component. A terminal contact 722 of the device side terminal 721 in contact with the circuit board 50 protrudes from the holding portion surface 750*fa*. The terminal contact 722 is in a state of being elastically deformable in a direction of an arrow YR1. A +Y direction side end portion of the device side terminal positioning portion 756 is positioned on the +Y direction side with respect to the terminal contact 722.

As illustrated in FIG. 12, the device side terminal portion 70 and the device side identification member 630 are provided on the support member 610, respectively. In the Y direction, which is the direction in which the support member 610 extends, the device side terminal portion 70 and the device side identification member 630 are positioned opposite to the first device wall 67 with the liquid introduction portion 642 or the opening 614 interposed therebetween. Specifically, the device side terminal portion 70 and the device side identification member 630 are provided in the vicinity of the second device wall 62. In addition, the device side terminal portion 70 is positioned on the second device wall 62 side, which is the −Y direction side with respect to the device side identification member 630. As a result, in the insertion process of the cartridge 4, after the fitting between the cartridge side identification member and the device side identification member 630 is started, contact between the device side terminal 721 and the cartridge side terminal 521 is started. Therefore, it is possible to prevent a storage device of the circuit board 50 and the control portion 31 from being electrically coupled to each other in a state in which the cartridge side terminal 521 of the wrong type of cartridge 4 and the device side terminal 721 come into contact with each other, such that the wrong type of cartridge 4 is mounted.

As illustrated in FIG. 10, the engagement forming body 677 is formed on the +Y direction side with respect to the support member 610. In addition, the engagement forming body 677 is positioned on the −Z direction side with respect to the insertion/removal opening 674. Four mounting engaging portions 697 illustrated in FIG. 3 are arranged in the engagement forming body 677 so as to correspond to the respective slots 61C to 61K.

A-5. Detailed Configuration of Cartridge 4

Figure 14:
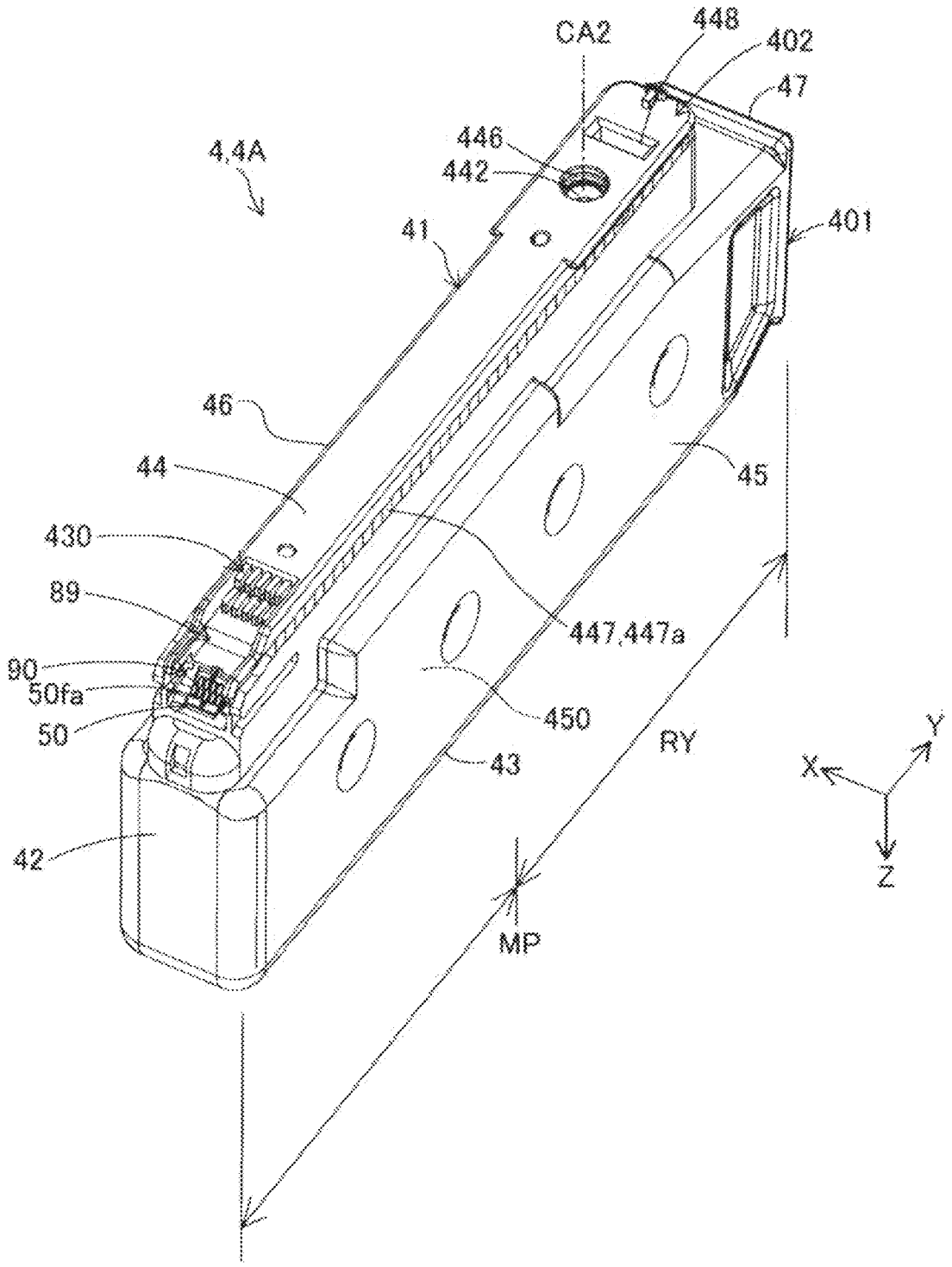
FIG. 14 is a perspective view of a first type of cartridge.
Figure 15:
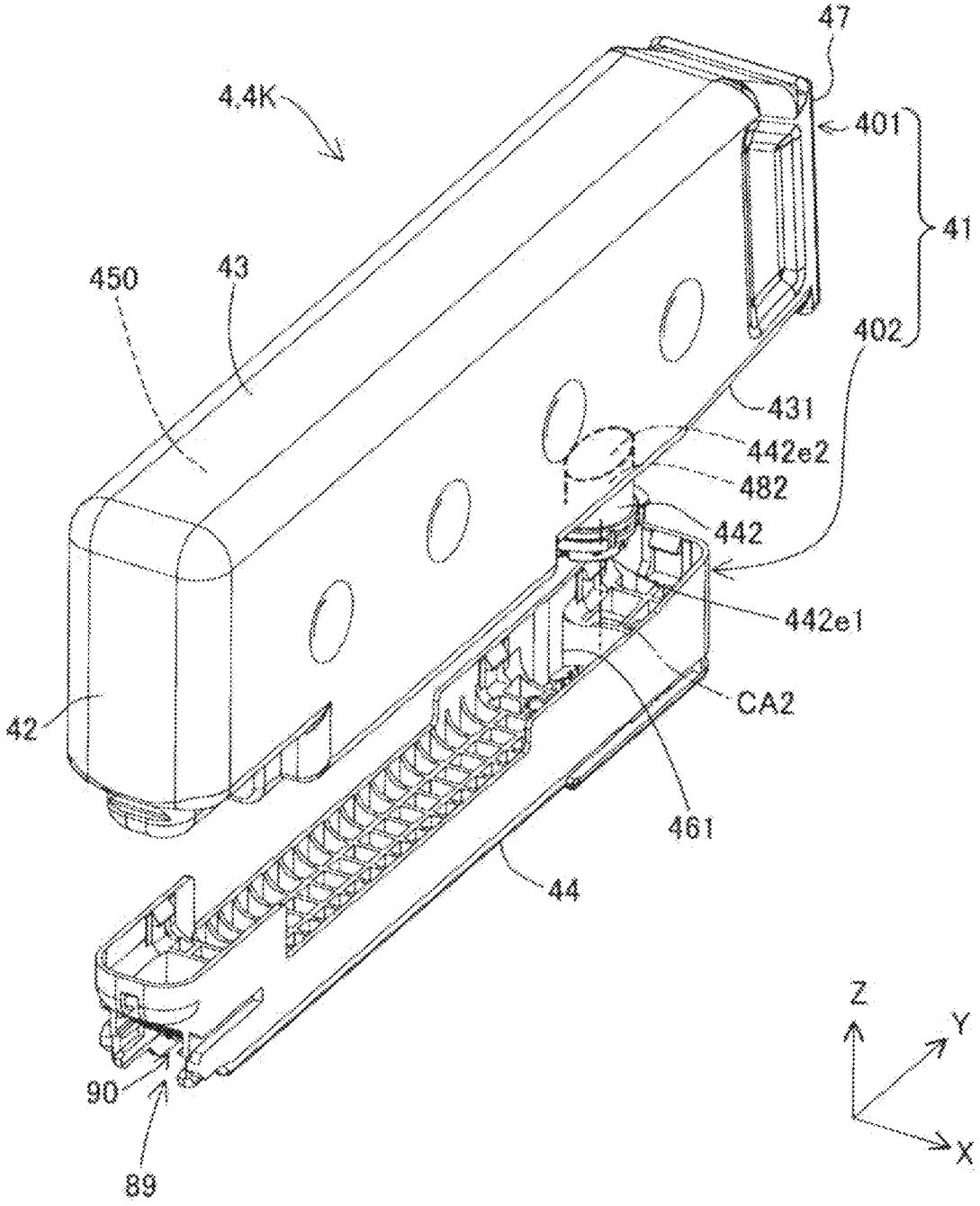
FIG. 15 is an exploded perspective view of the first type of cartridge.
Figure 16:
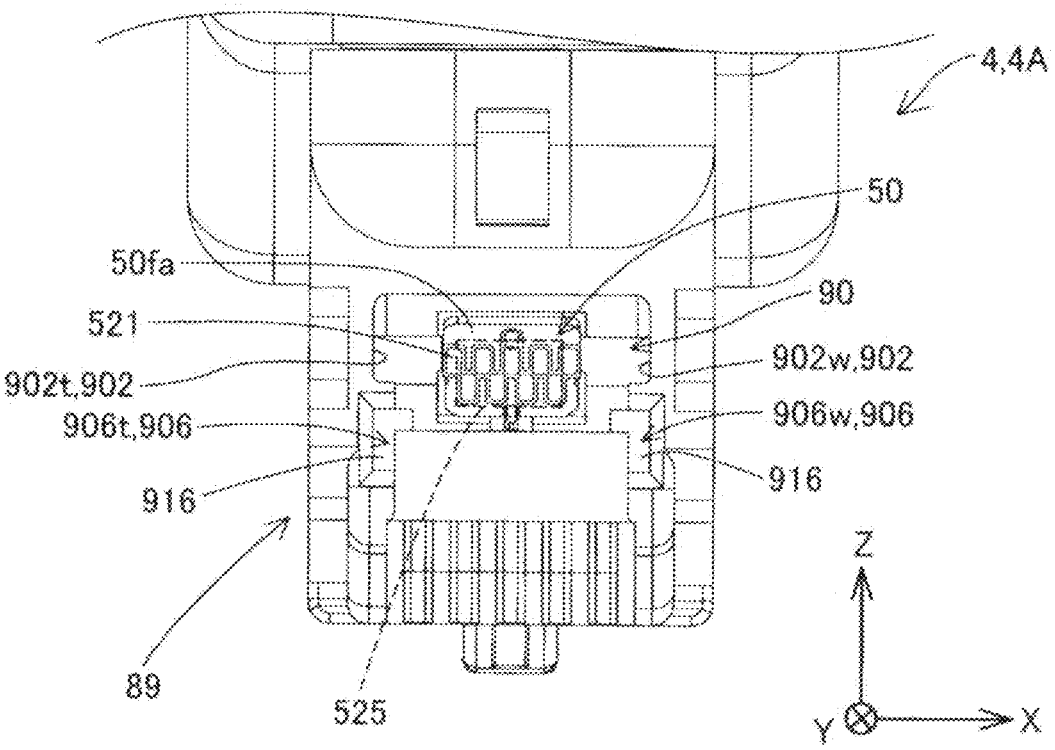
FIG. 16 is a first view illustrating a part of the first type of cartridge.
Figure 17:
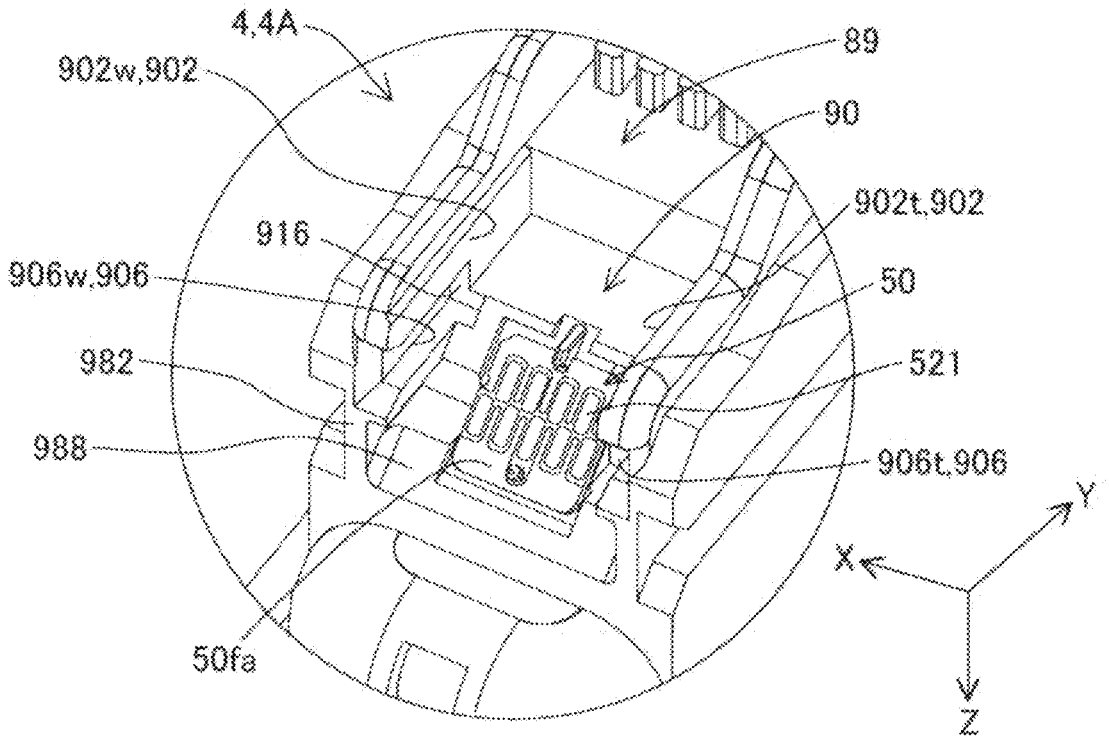
FIG. 17 is a second view illustrating a part of the first type of cartridge.
Figure 18:
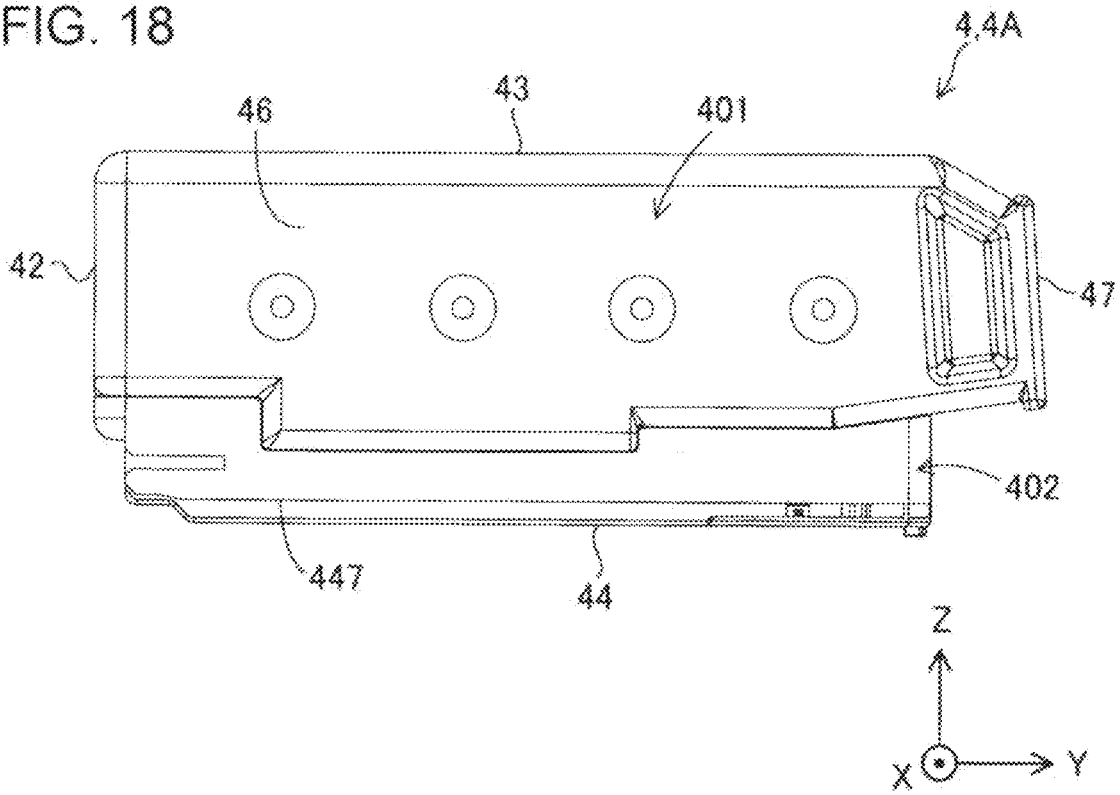
FIG. 18 is a first side view of the first type of cartridge.
Figure 19:
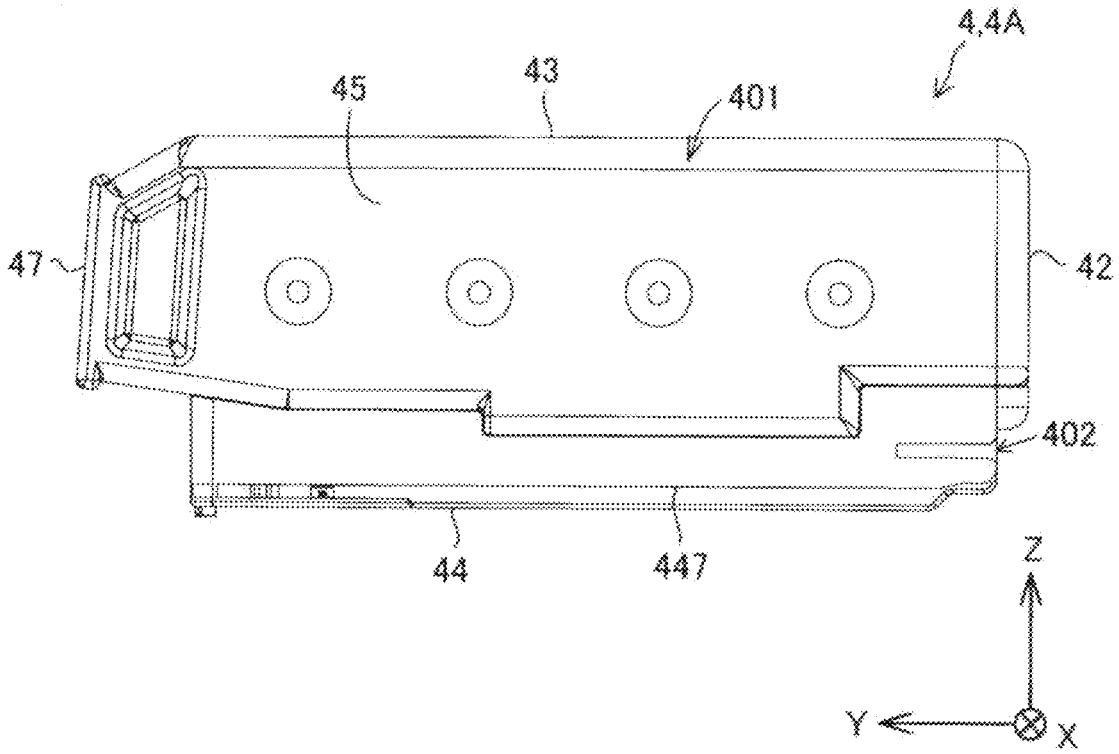
FIG. 19 is a second side view of the first type of cartridge.
Figure 20:
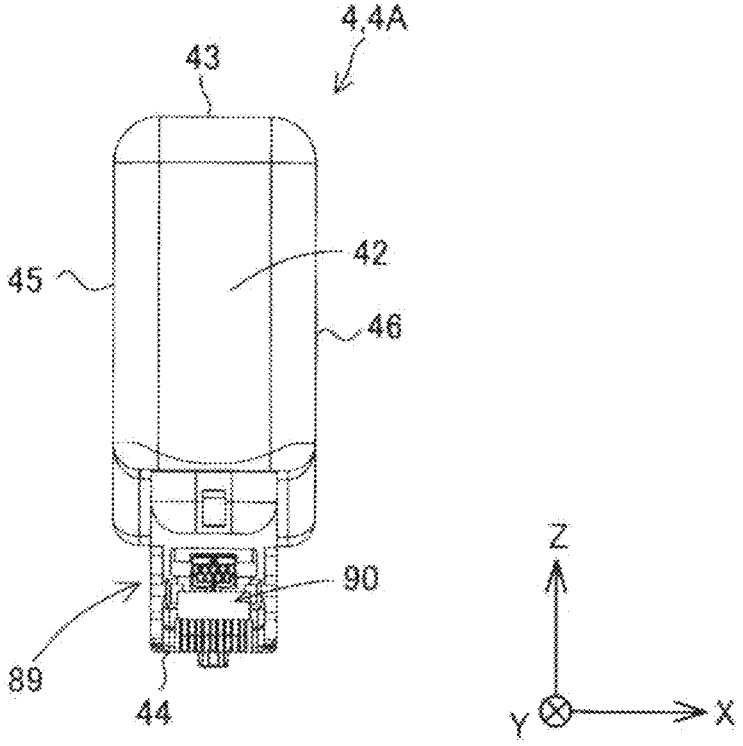
FIG. 20 is a front view of the first type of cartridge.
Figure 21:
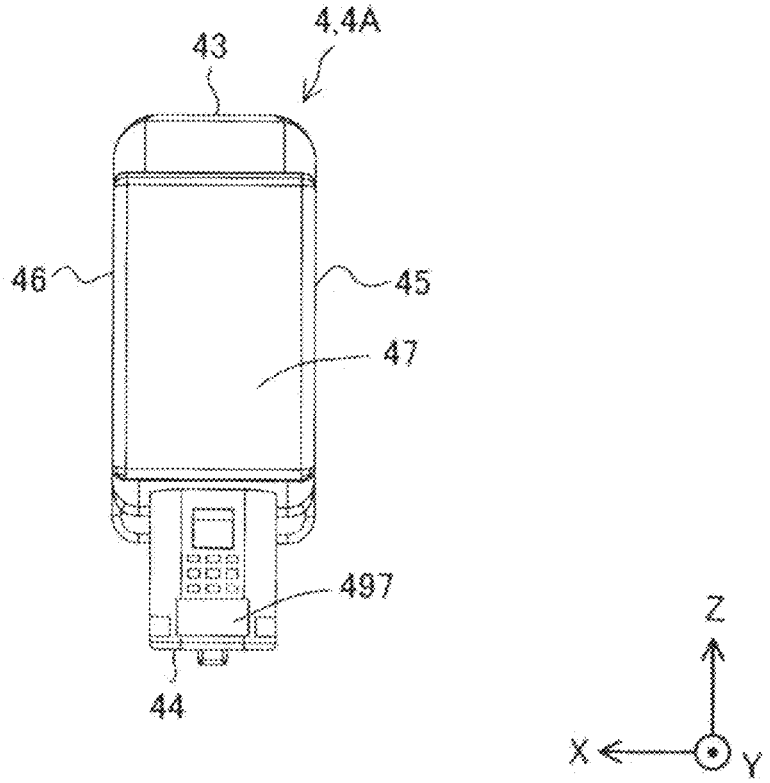
FIG. 21 is a rear view of the first type of cartridge.
Figure 22:
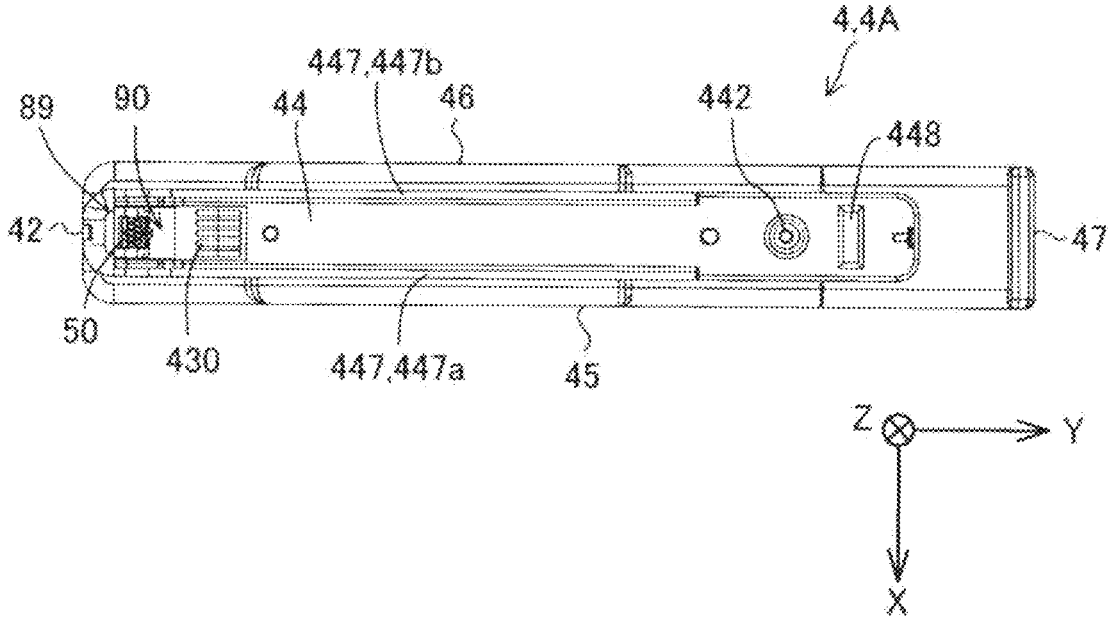
FIG. 22 is a top view of the first type of cartridge.

FIG. 14 is a perspective view of the first type of cartridge 4A. FIG. 15 is an exploded perspective view of the first type of cartridge 4A. FIG. 16 is a first view illustrating a part of the first type of cartridge 4A. FIG. 17 is a second view illustrating a part of the first type of cartridge 4A. FIG. 18 is a first side view of the first type of cartridge 4A. FIG. 19 is a second side view of the first type of cartridge 4A. FIG. 20 is a front view of the first type of cartridge 4A. FIG. 21 is a rear view of the first type of cartridge 4A. FIG. 22 is a top view of the first type of cartridge 4A. Regarding the cartridge 4, the Y direction is a depth direction, the Z direction is a height direction, and the X direction is a width direction. The cartridge 4 is a cartridge that contains a large amount of liquid and has a large outer shape. Regarding the outer shape of the cartridge 4, a dimension in the Y direction is the greatest, and a dimension in the Z direction and a dimension in the X direction are smaller in this order. In the drawings illustrating the cartridge 4, the X direction, the Y direction, and the Z direction are based on a completed state of the terminal coupling process, which is a state in which the insertion of the cartridge 4 into the cartridge mounting portion 6 has been completed. That is, in the drawings illustrating the cartridge 4, the X direction, the Y direction, and the Z direction are based on a state before the supply portion coupling process for rotationally moving the support member 610.

As illustrated in FIG. 14, the first type of cartridge 4A includes a liquid container 401 forming a top wall 43 and an adapter 402 forming a bottom wall 44. The adapter 402 is attached to the liquid container 401 by fitting. The liquid container 401 and the adapter 402 are formed of a synthetic resin. The liquid container 401 and the adapter 402 may be formed of the same material or may be formed of different materials. In addition, a member forming the liquid container 401 may be lighter than a member forming the adapter 402. By doing so, operability of the cartridge 4 is improved.

An outer shape of the first type of cartridge 4A is a substantially rectangular parallelepiped shape. The first type of cartridge 4A includes a main body 41 forming an outer shell and a circuit board 50 attached to the main body 41. The main body 41 is formed by the liquid container 401 and the adapter 402 described above. The main body 41 of the first type of cartridge 4A has a front wall 42, a rear wall 47, the top wall 43, the bottom wall 44, a first side wall 45, a second side wall 46, and a corner portion 89. Each wall 42, 43, 44, 45, 46, or 47 is also referred to as each surface 42, 43, 44, 45, 46, or 47. The front wall 42 and the rear wall 47 face each other in the Y direction along the insertion direction. The top wall 43 and the bottom wall 44 face each other in the Z direction. The Z direction is parallel to the central axis CA2 along the direction in which the liquid supply portion 442 extends. The first side wall 45 and the second side wall 46 face each other in the X direction. The X direction is a direction orthogonal to the Y direction and the Z direction.

As illustrated in FIG. 18, the front wall 42 is positioned on an insertion direction side in which the cartridge 4 is inserted into the cartridge mounting portion 6. That is, the front wall 42 forms an insertion tip surface on the −Y direction side, which is the insertion direction side. The rear wall 47 forms a surface on the +Y direction side, which is the removal direction side. The top wall 43 is positioned on the +Z direction side and intersects the front wall 42 and the rear wall 47. As illustrated in FIG. 14, the bottom wall 44 is positioned on the −Z direction side, which is the gravity direction side in the mounted state, and forms a coupling tip surface in the coupling direction D2 illustrated in FIG. 3. That is, the bottom wall 44 is positioned on the coupling direction D2 side. The bottom wall 44 intersects the front wall 42 and the rear wall 47. An insertion opening 446 is formed in the bottom wall 44. The liquid supply portion 442 is arranged in the insertion opening 446. The liquid supply portion 442 is arranged so that the central axis CA2 of the liquid supply portion 442 passes through the insertion opening 446. In the mounting process of the cartridge 4, the liquid introduction portion 642 of the cartridge mounting portion 6 is inserted into the insertion opening 446. The insertion opening 446 and the liquid supply portion 442 are positioned in a region RY between a middle portion MP of the cartridge 4 and an end portion adjacent to the rear wall 47 in the insertion direction.

As illustrated in FIG. 20, the first side wall 45 is positioned on the −X direction side, and the second side wall 46 is positioned on the +X direction side. Each of the first side wall 45 and the second side wall 46 intersects the front wall 42, the rear wall 47, the top wall 43, and the bottom wall 44. The corner portion 89 is provided at a corner portion where the front wall 42 and the bottom wall 44 intersect each other. The corner portion 89 has a recess portion 90 recessed inward.

The first type of cartridge 4A further includes the liquid containing portion 450 containing a liquid, the liquid supply portion 442, a cartridge side identification member 430, the supply portion positioning portion 448, the circuit board 50, and a cartridge guide portion 447 that are illustrated in FIG. 14, and the cartridge engaging portion 497 illustrated in FIG. 21.

The liquid supply portion 442 is a tubular member that protrudes from the container bottom wall 431, which is a bottom wall of the liquid container 401, toward the adapter 402. The liquid supply portion 442 is arranged in a recess-shaped supply portion arrangement chamber 461 of the adapter 402. The insertion opening 446 illustrated in FIG. 14 is formed at a recess-shaped bottom portion of the supply portion arrangement chamber 461. The cartridge side valve mechanism 481 described above is arranged in the liquid supply portion 442.

The cartridge side identification member 430 illustrated in FIG. 14 is used to identify whether or not the cartridge 4 has been inserted into the correct slot 61C, 61M, 61Y, or 61K of the cartridge mounting portion 6. The cartridge side identification member 430 is a rib arranged on a side of the bottom wall 44 close to the front wall 42, that is, at a position adjacent to the corner portion 89 in the present embodiment. The cartridge side identification members 430 form different pattern shapes depending on the colors of the liquids contained in the cartridges 4C, 4M, 4Y, and 4K. The pattern shape is determined by the number and positions of ribs.

The supply portion positioning portion 448 performs positioning of the liquid supply portion 442 with respect to the liquid introduction portion 642 by receiving the device side supply portion positioning portion 644. Specifically, in the supply portion coupling process, the supply portion positioning portion 448 performs positioning of the liquid supply portion 442 with respect to the liquid introduction portion 642 by receiving the device side supply portion positioning portion 644 to regulate the movement of the supply portion positioning portion 448 in a direction intersecting the coupling direction D2. The supply portion positioning portion 448 is a recess portion formed in the bottom wall 44 and recessed from an outer surface of the bottom wall 44. Note that in another embodiment, the supply portion positioning portion 448 may be a hole penetrating through the bottom wall 44. The supply portion positioning portion 448 is a recess portion having a substantially rectangular parallelepiped shape, and an opening area of an entrance portion formed on an outer surface side of the bottom wall 44 is greater than an opening area on a bottom portion side of the recess portion, which is a side deeper than the entrance portion. As a result, in the supply portion coupling process, the supply portion positioning portion 448 can easily receive the device side supply portion positioning portion 644. The supply portion positioning portion 448 is positioned opposite to the cartridge side terminal 521 of the circuit board 50 with the liquid supply portion 442 or the insertion opening 446 interposed therebetween, in the insertion direction. In the present embodiment, the supply portion positioning portion 448 is formed in the bottom wall 44 in the vicinity of the rear wall 47.

As illustrated in FIG. 21, the cartridge engaging portion 497 is provided in the rear wall 47. The cartridge engaging portion 497 is a recess portion recessed from an outer surface of the rear wall 47.

As illustrated in FIG. 16, the circuit board 50 is arranged at the corner portion 89. The circuit board 50 has a plurality of cartridge side terminals 521 arranged on a front surface 50*fa* and a storage device 525 arranged on a rear surface. The plurality of cartridge side terminals 521 that can be coupled to the device side terminals by coming into contact with the device side terminals are electrically coupled to the storage device 525 via wirings. The plurality of cartridge side terminals 521 (nine cartridge side terminals in the present embodiment) are provided. The front surface 50*fa* on which the plurality of cartridge side terminals 521 are arranged is inclined with respect to the insertion direction. Specifically, the front surface 50*fa* is inclined with respect to the insertion direction toward a direction including a −Z direction component and a −Y direction component. The storage device 525 stores information regarding the cartridge 4, for example, the date of manufacture or the remaining amount of liquid. In the mounted state, the plurality of cartridge side terminals 521 are electrically coupled to the corresponding device side terminals 721 by coming into contact with the corresponding device side terminals 721. As a result, the control portion 31 of the printing device 10 and the storage device 525 are electrically coupled to each other, such that data communication between the control portion 31 of the printing device 10 and the storage device 525 becomes possible.

As illustrated in FIG. 17, the circuit board 50 is arranged in the recess portion 90 of the corner portion 89. As illustrated in FIG. 14, the recess portion 90 is provided over the front wall 42 and the bottom wall 44. As illustrated in FIG. 17, the recess portion 90 has a recess portion front wall 982 forming an entrance opening positioned on the front wall 42 side, a recess portion bottom wall 988 forming a bottom portion of the recess portion 90, and a pair of recess portion side walls 902*t* and 902*w*.

The recess portion bottom wall 988 has a portion inclined with respect to the Y direction. In the present embodiment, the inclined portion is inclined with respect to the Y direction so as to be positioned on the +Z direction side toward the recess portion front wall 982. The circuit board 50 is arranged on this inclined portion.

The pair of recess portion side walls 902*t* and 902*w* are walls coupled to the recess portion bottom wall 988. The pair of recess portion side walls 902*t* and 902*w* face each other in the X direction. A first recess portion side wall 902*t* is coupled to a −X direction side end portion of the recess portion bottom wall 988. A second recess portion side wall 902*w* is coupled to a +X direction side end portion of the recess portion bottom wall 988. When the first recess portion side wall 902*t* and the second recess portion side wall 902*w* are used without distinction, the first recess portion side wall 902*t* and the second recess portion side wall 902*w* are referred to as a recess portion side wall 902. An entrance opening, which is an opening formed in the recess portion front wall 982, becomes an entrance when the device side terminal portion 70 is inserted into the recess portion 90.

The pair of recess portion side walls 902*t* and 902*w* are provided with a pair of terminal positioning portions 906*t* and 906*w*, respectively. The pair of terminal positioning portions 906*t* and 906*w* are provided so as to face each other in the X direction. When the pair of terminal positioning portions 906*t* and 906*w* are used with distinction, the pair of terminal positioning portions 906*t* and 906*w* are also referred to as a first terminal positioning portion 906*t* and a second terminal positioning portion 906*w*, and when the pair of terminal positioning portions 906*t* and 906*w* are used without distinction, the pair of terminal positioning portions 906*t* and 906*w* are also referred to as a terminal positioning portion 906. The terminal positioning portion 906 is a groove formed in the recess portion side wall 902. The first terminal positioning portion 906*t* is a groove having a shape recessed from a surface of the first recess portion side wall 902*t*. The second terminal positioning portion 906*w* is a groove having a shape recessed from a surface of the second recess portion side wall 902*w*.

The first terminal positioning portion 906*t* receives the first device side terminal positioning portion 756*t* illustrated in FIG. 12 in the terminal coupling process. That is, the first device side terminal positioning portion 756*t* is inserted into the first terminal positioning portion 906*t*. The second terminal positioning portion 906*w* receives the second device side terminal positioning portion 756*w* illustrated in FIG. 12 in the terminal coupling process. That is, the second device side terminal positioning portion 756*w* is inserted into the second terminal positioning portion 906*t*. The insertion of the device side terminal positioning portion 756 into the terminal positioning portion 906 is performed after the fitting between the cartridge side identification member 430 and the device side identification member 630 has been started. In addition, the insertion of the device side terminal positioning portion 756 into the terminal positioning portion 906 is started before the contact between the device side terminal 721 and the cartridge side terminal 521 is started.

The device side terminal positioning portion 756 is received by the terminal positioning portion 906, such that the device side terminal positioning portion 756 and the terminal positioning portion 906 come into contact with each other. As a result, the movement of the cartridge side terminal 521 with respect to the device side terminal 721 in the Z direction and the X direction, which are the directions intersecting the insertion direction, is regulated. The movement is regulated, such that positioning of the cartridge side terminal 521 with respect to the device side terminal 721 in the Z direction and the X direction, which are the directions intersecting the insertion direction, is performed. The terminal positioning portion 906 has an end wall 916 on the +Y direction side. The cartridge 4 is further pushed toward the insertion direction from an abutting position where a tip portion of the device side terminal positioning portion 756 abuts on the end wall 916, such that the terminal coupling process is completed. The cartridge 4 is further pushed toward the insertion direction from the abutting position, such that the holding mechanism 73 is pushed toward the insertion direction. As a result, the device side terminal portion 70 moves toward the insertion direction following the movement of the cartridge 4. In a state in which the terminal coupling process is completed, the urging member 780 illustrated in FIG. 7 is in a compressed state. In addition, in the state in which the terminal coupling process is completed, the device side terminal 721 and the cartridge side terminal 521 come into contact with each other.

As illustrated in FIGS. 14 and 22, the cartridge guide portions 447 extend along the −Y direction, which is the insertion direction. The cartridge guide portions 447 are guided in the insertion direction by the device guide portions 602 of the cartridge mounting portion 6. The cartridge guide portions 447 are formed on the first side wall 45 and the second side wall 46, respectively. In FIG. 14, the cartridge guide portion 447 formed on the first side wall 45 is shown with single hatching. The cartridge guide portions 447 are formed on the first side wall 45 and the second side wall 46, respectively, by steps. That is, regarding a width of the cartridge 4, a part including the bottom wall 44 is smaller than the other part positioned away from the bottom wall 44 than a bottom wall side portion. As a result, the step forming the cartridge guide portion 447 is formed. The cartridge guide portion 447 is a surface facing the −Z direction. The cartridge guide portion 447 formed on the first side wall 45 is also referred to as a first cartridge guide portion 447*a*, and the cartridge guide portion 447 formed on the second side wall 46 is also referred to as a second cartridge guide portion 447*b*.

When the cartridge 4 is inserted into the cartridge mounting portion 6, a surface of the device guide portion 602 on the +Z direction side and the cartridge guide portion 447 come into contact with each other, such that the movement of the cartridge 4 in the insertion direction is guided in a state in which a posture of the cartridge 4 is maintained. A surface of the first device guide portion 602*a* on the +Z direction side comes into contact with the first cartridge guide portion 447*a*, and a surface of the second device guide portion 602*b* on the +Z direction side comes into contact with the second cartridge guide portion 447*b*.

As illustrated in FIGS. 14 and 15, the adapter 402 includes the corner portion 89 having the terminal positioning portion 906 and the cartridge side terminal 521, the cartridge side identification member 430, the insertion opening 446, the supply portion positioning portion 448, the cartridge guide portion 447, and the supply portion arrangement chamber 461.

Figure 23:
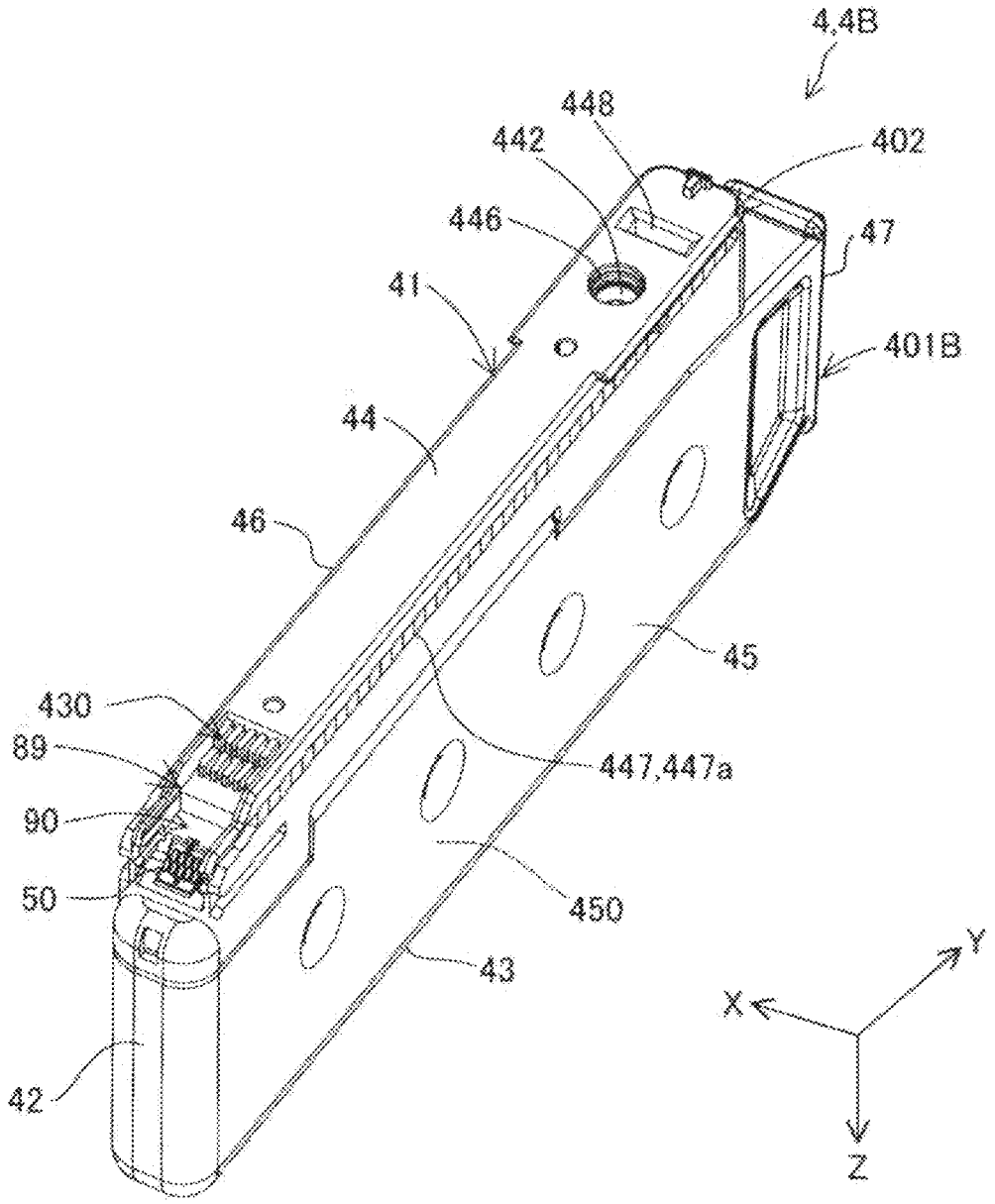
FIG. 23 is a perspective view of a second type of cartridge.
Figure 24:
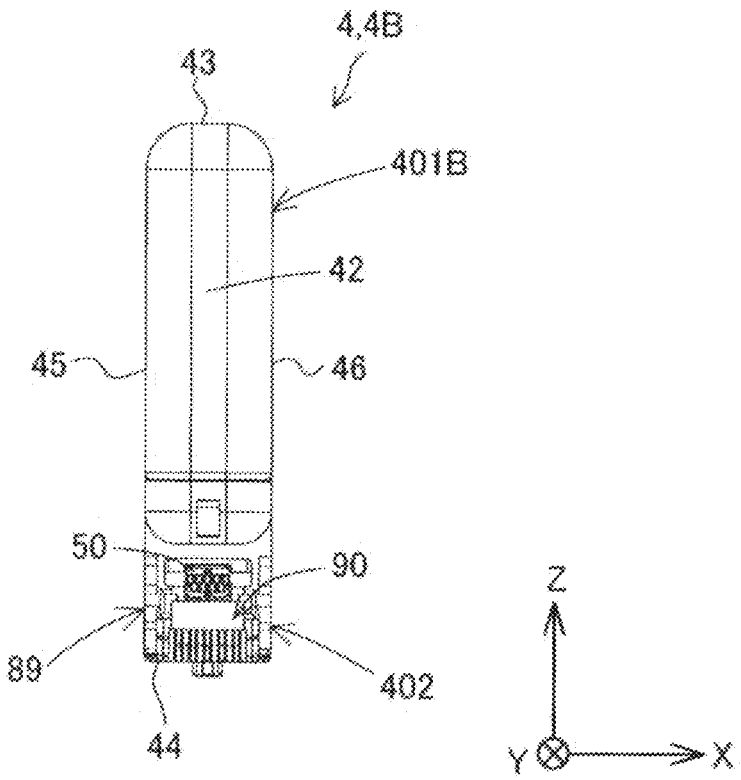
FIG. 24 is a front view of the second type of cartridge.
Figure 25:
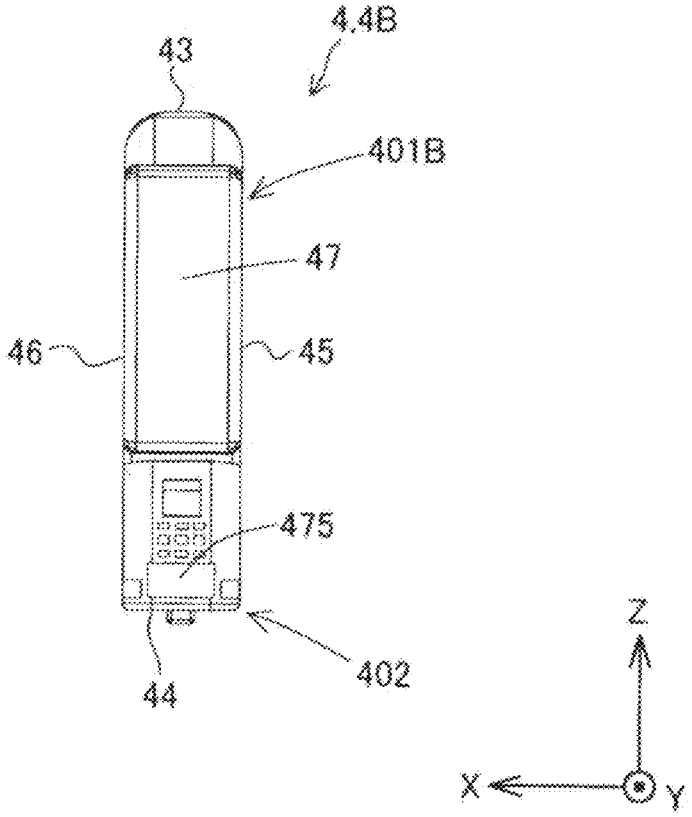
FIG. 25 is a rear view of the second type of cartridge.

FIG. 23 is a perspective view of the second type of cartridge 4B. FIG. 24 is a front view of the second type of cartridge 4B. FIG. 25 is a rear view of the second type of cartridge 4B. A difference between the second type of cartridge 4B and the first type of cartridge 4A is that a width of a liquid container 401B is smaller than that of the liquid container 401 illustrated in FIG. 14. As a result, an amount of liquid that can be contained in a liquid containing portion 450 formed in the liquid container 401B is smaller than an amount of the liquid that can be contained in the liquid containing portion 450 formed in the liquid container 401. Since the other components of the second type of cartridge 4B are the same as those of the first type of cartridge 4A, the same components will be denoted by the same reference numerals, and a description thereof will be omitted.

An adapter 402 of the second type of cartridge 4B has the same configuration as the adapter 402 of the first type of cartridge 4A except for a pattern shape formed by a cartridge side identification member 430. As a result, the adapter 402 can be commonly used for the cartridges 4A and 4B having different capacities.

A-6. Mounting Process of Cartridge in Cartridge Mounting Portion

Figure 26:
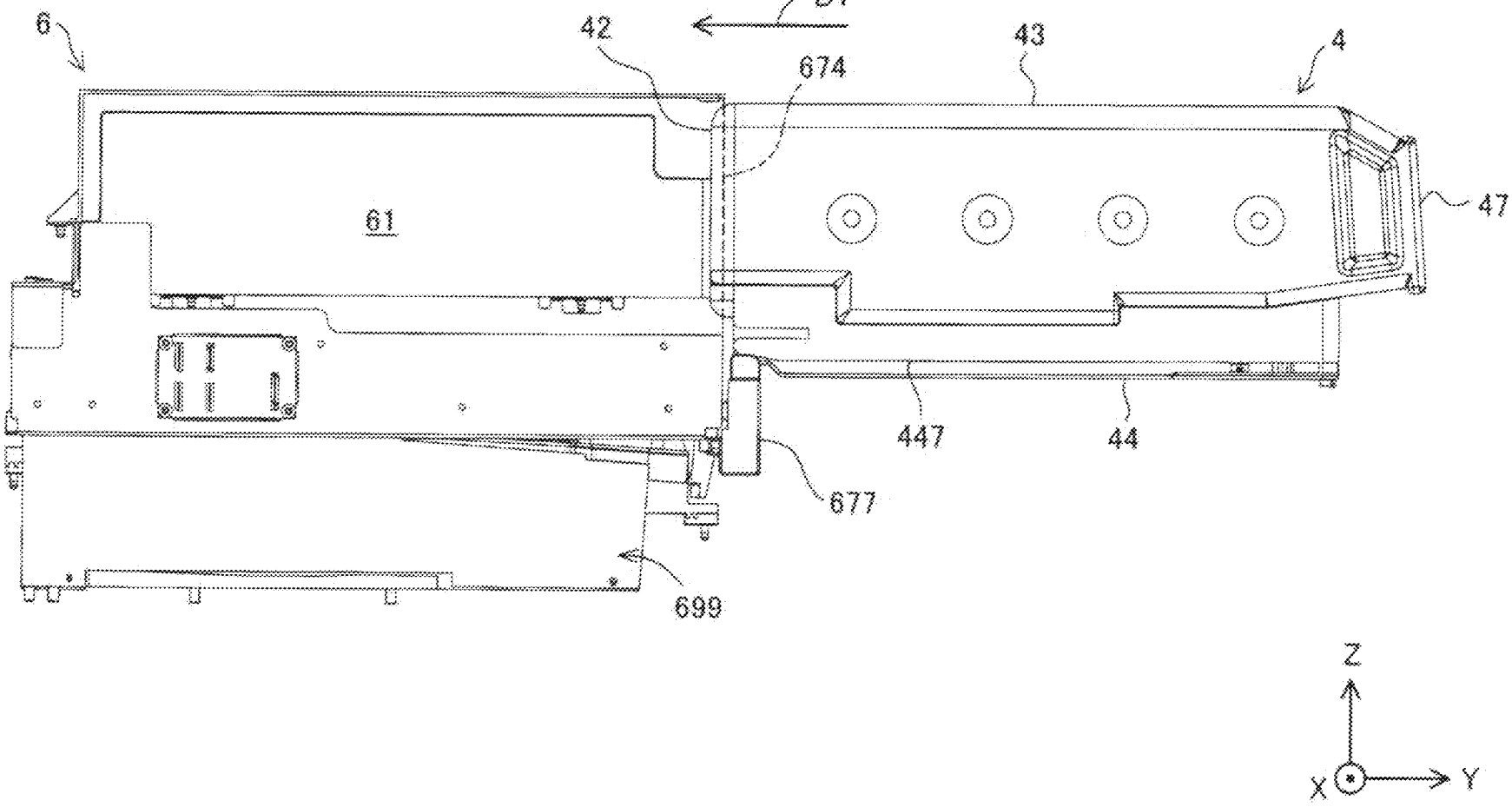
FIG. 26 is a first view for describing a mounting process.
Figure 27:
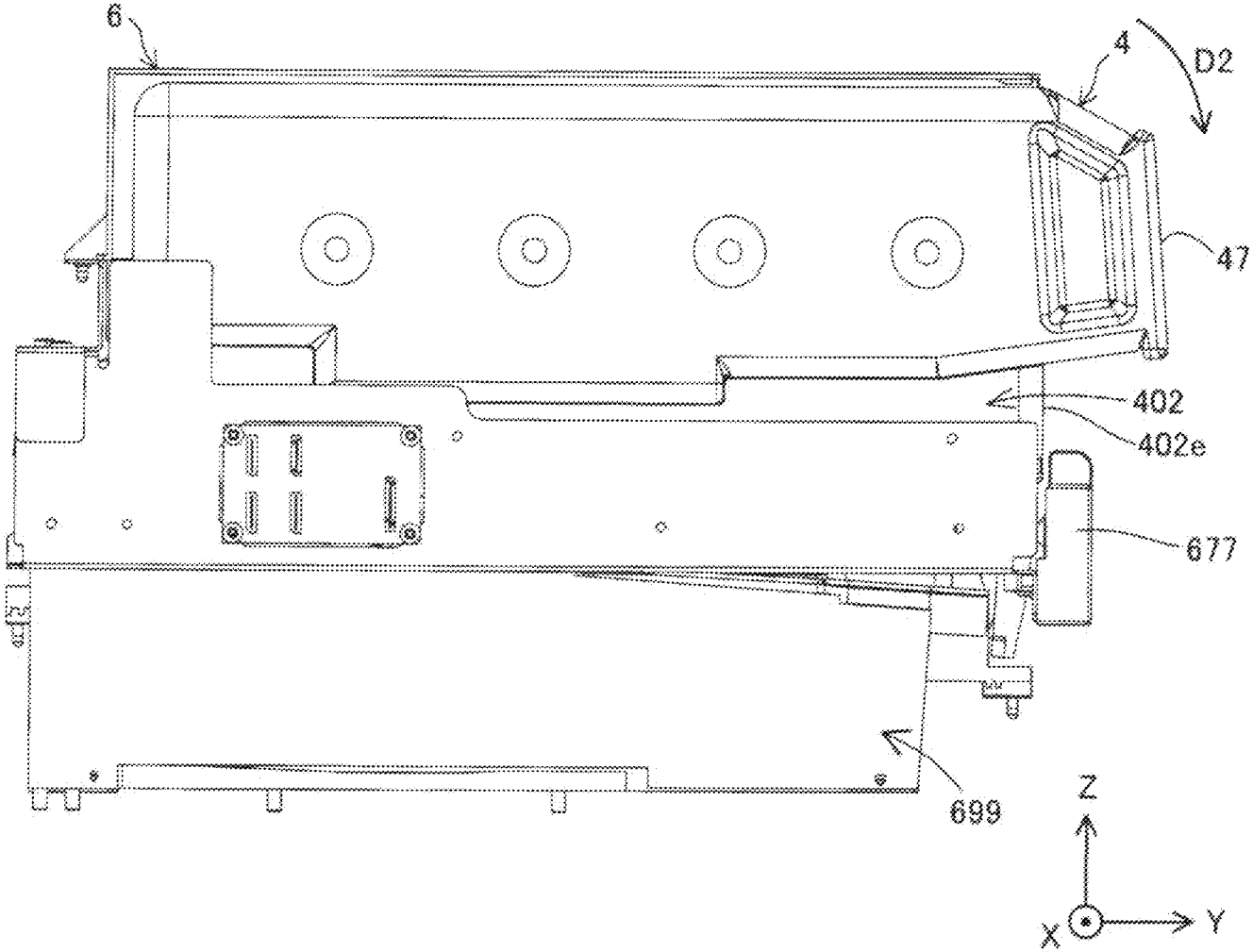
FIG. 27 is a second view for describing the mounting process.
Figure 28:
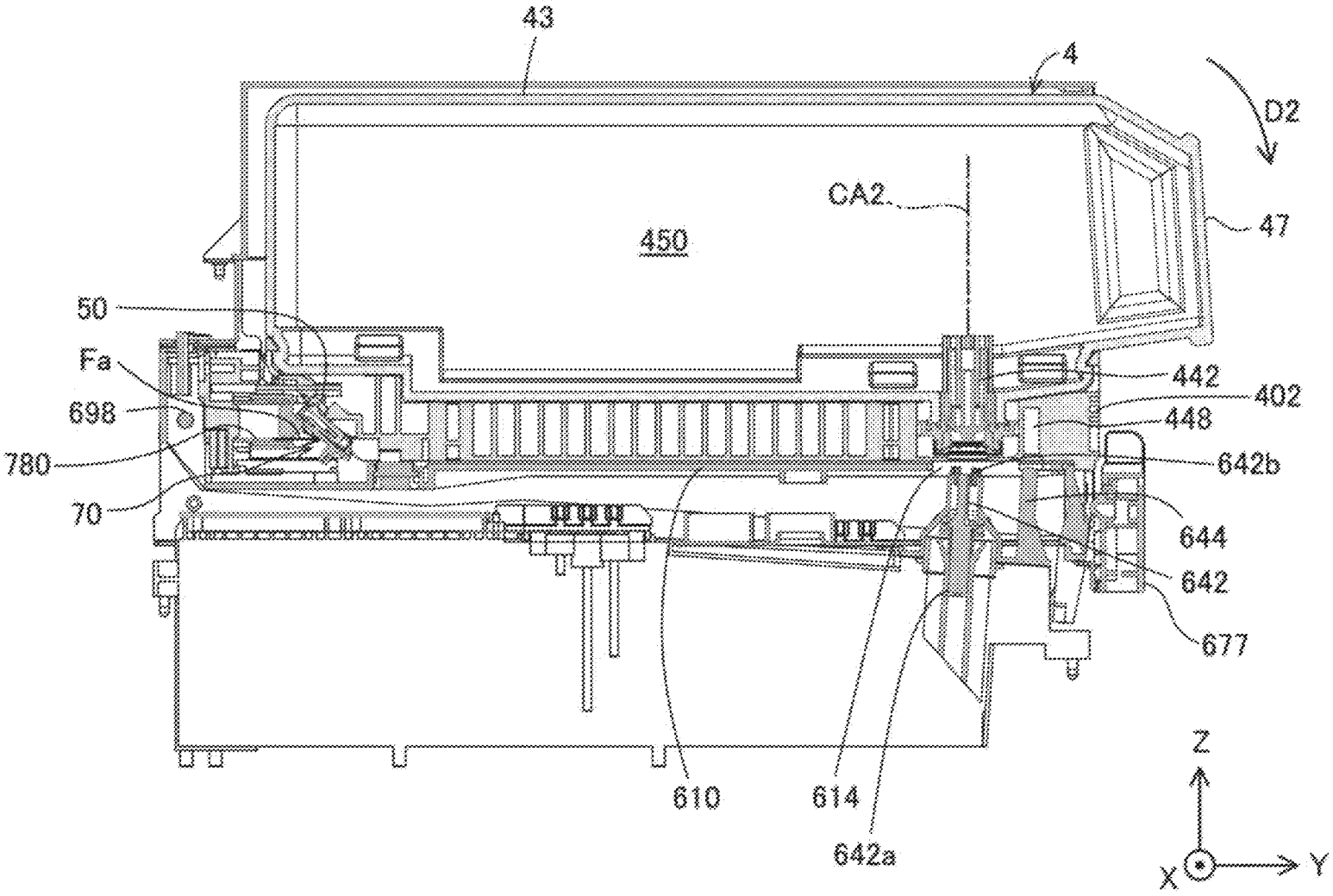
FIG. 28 is a sectional view of FIG. 27.
Figure 29:
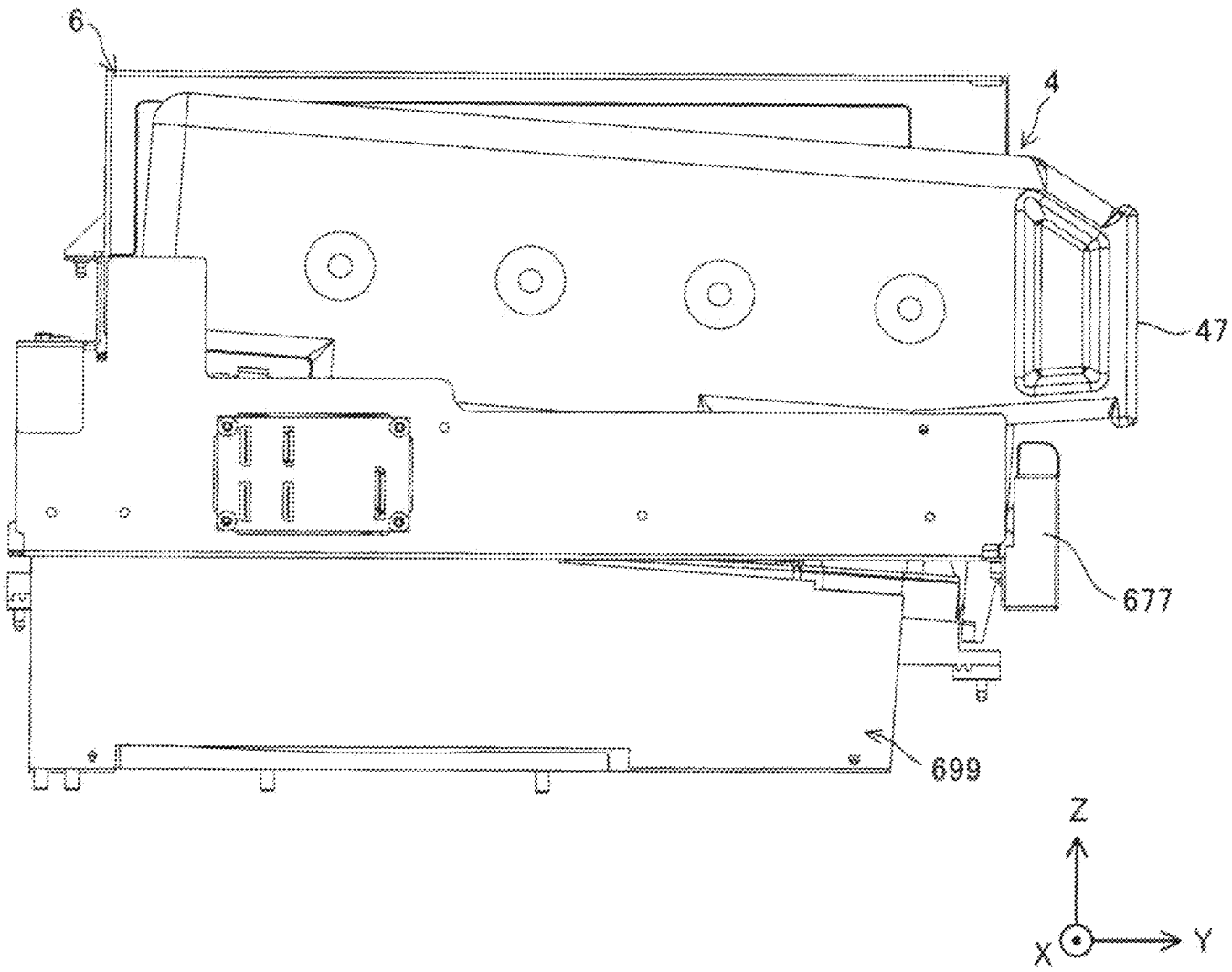
FIG. 29 is a third view for describing the mounting process.
Figure 30:
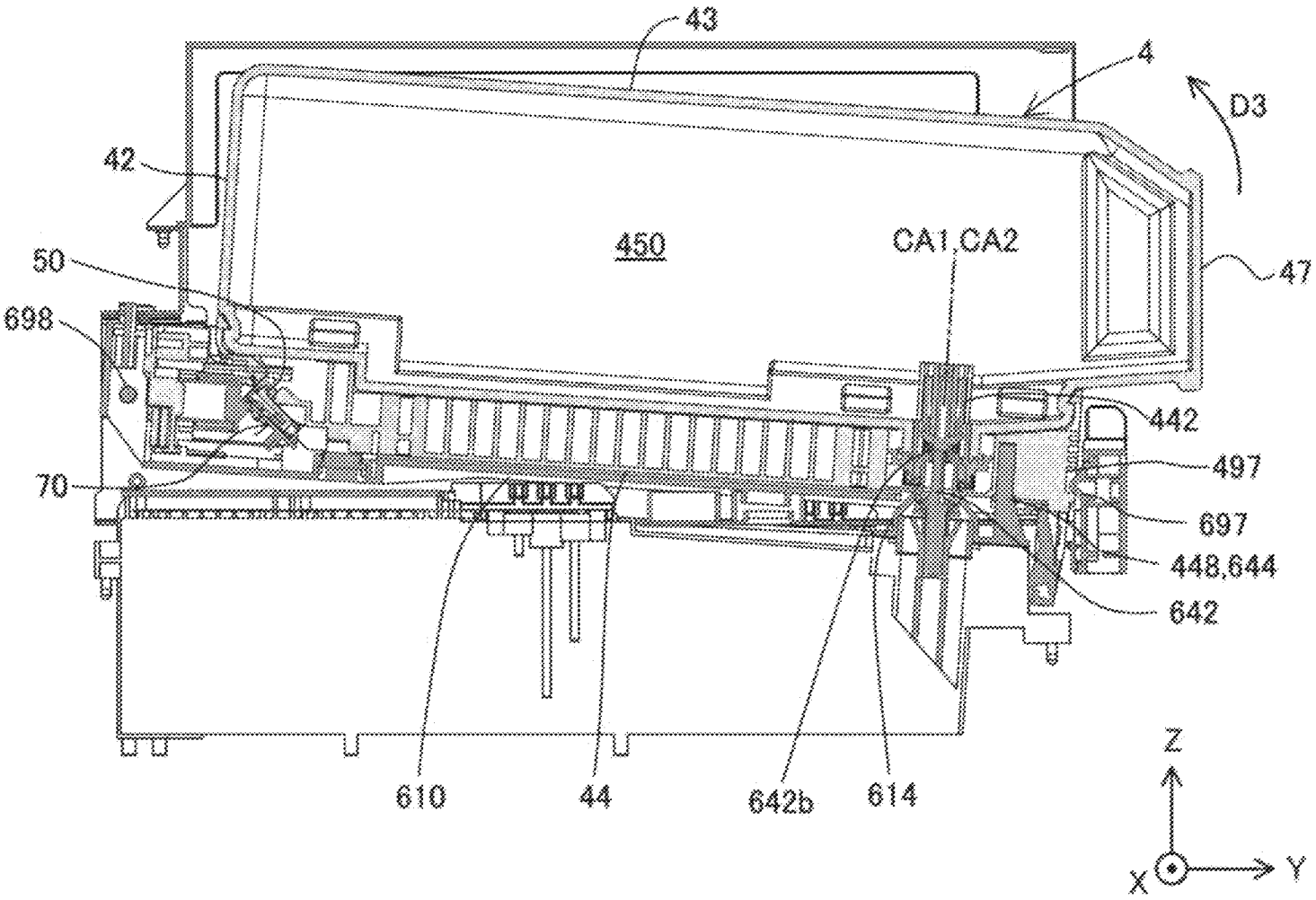
FIG. 30 is a sectional view of FIG. 29.

FIG. 26 is a first view for describing a mounting process. FIG. 27 is a second view for describing the mounting process. FIG. 28 is a sectional view of FIG. 27, and is a view corresponding to a cross section taken along line III-III of FIG. 2. FIG. 29 is a third view for describing the mounting process. FIG. 30 is a sectional view of FIG. 29, and is a view corresponding to a cross section taken along line III-III of FIG. 2. FIGS. 26 to 28 illustrate the terminal coupling process, and FIGS. 29 and 30 illustrate the supply portion coupling process.

As illustrated in FIG. 26, when the cartridge 4 is mounted in the cartridge mounting portion 6, the cartridge 4 is first inserted from the insertion/removal opening 674 of the cartridge mounting portion 6 into the accommodation chamber 61. An insertion direction D1 of the cartridge 4 into the cartridge mounting portion 6 is the −Y direction, and is parallel to a direction in which the cartridge guide portion 447 extends.

When the cartridge 4 is further pushed in the insertion direction D1 in a state illustrated in FIG. 26, the terminal coupling process is completed as illustrated in FIG. 27. In the completed state of the terminal coupling process illustrated in FIG. 27, an end portion 402*e* of the adapter 402 on the +Y direction side is positioned on the insertion direction side with respect to the engagement forming body 677. In addition, as illustrated in FIG. 28, in the completed state of the terminal coupling process, the cartridge side terminal 521 and the device side terminal 721 are in contact with each other. In addition, in the completed state of the terminal coupling process, the urging member 780 is compressed, and the device side terminal portion 70 receives an external force Fa from the urging member 780. The user executes the supply portion coupling process by rotationally moving the cartridge 4 in the coupling direction D2 with the rotation fulcrum 698 as the fulcrum while pushing the cartridge 4 toward the insertion direction.

When the cartridge 4 rotationally moves in the coupling direction D2, the reception of the device side supply portion positioning portion 644 by the supply portion positioning portion 448 is started before the coupling between the liquid introduction portion 642 and the liquid supply portion 442 is started. Thereafter, the positioning of the liquid supply portion 442 with respect to the liquid introduction portion 642 is started. That is, the movement of the liquid supply portion 442 in a direction intersecting the central axis CA2 of the liquid supply portion 442 is regulated. In the supply portion coupling process, when the device side supply portion positioning portion 644 is inserted into the liquid introduction portion 642, a case where the cartridge 4 moves minutely in the Y direction can occur. In this case, the urging member 780 expands and contracts, such that the device side terminal portion 70 moves so as to follow the movement of the cartridge side terminal 521. As a result, contact between the cartridge side terminal 521 and the device side terminal 721 can be maintained well.

As illustrated in FIG. 30, in the mounted state of the cartridge 4 in which the supply portion coupling process is completed, the cartridge side terminal 521 of the circuit board 50 and the device side terminal 721 of the device side terminal portion 70 come into contact with each other, such that the liquid supply portion 442 and the liquid introduction portion 642 are coupled to each other. In the mounted state, the insertion direction D1 of the cartridge 4 intersects the direction in which the liquid supply portion 442 extends. In addition, in the mounted state, the cartridge 4 is mounted in the cartridge mounting portion 6 so that the direction in which the liquid supply portion 442 extends becomes a direction including a gravity direction component. As a result, the liquid in the liquid supply portion 442 can be made to smoothly flow. Therefore, an amount of liquid remaining in the liquid containing portion 450 without being consumed can be reduced.

In addition, in the mounted state, the mounted state of the cartridge 4 is maintained by engaging the mounting engaging portion 697 with the cartridge engaging portion 497. In a decoupling process in which the liquid introduction portion 642 and the liquid supply portion 442 are decoupled from each other, the user rotationally moves the cartridge 4 in a decoupling direction D3, which is a direction opposite to the coupling direction D2, with the rotation fulcrum 698 as the fulcrum by lifting the rear wall 47 side of the cartridge 4. As a result, the mounting engaging portion 697 is displaced by being pushed by the main body of the cartridge 4, such that the engagement between the mounting engaging portion 697 and the cartridge engaging portion 497 is released.

According to the above embodiment, as illustrated in FIG. 30, the cartridge 4 has the liquid supply portion 442 arranged on the bottom wall 44 intersecting the front wall 42 positioned on the insertion direction side. As a result, in the mounted state, the bottom wall 44 is positioned on the gravity direction side, and the liquid in the liquid containing portion 450 can thus be made to smoothly flow to the liquid supply portion 442. As a result, an amount of liquid remaining in the liquid containing portion 450 without being consumed can be reduced. In addition, as illustrated in FIG. 26, the insertion direction D1 of the cartridge 4 and the removal direction, which is a direction opposite to the insertion direction D1, are the Y direction and a direction along the horizontal direction. As a result, when the cartridge 4 is inserted into and removed from the cartridge mounting portion 6, the cartridge 4 is only required to be moved in the horizontal direction, and the operability of the cartridge 4 can thus be improved. In particular, as in the present embodiment, the cartridge 4 having a large outer shape for accommodating a large amount of liquid can be inserted into and removed from the cartridge mounting portion 6 along the horizontal direction, and the operability of the cartridge 4 can thus be further improved. As described above, in the mounted state of the cartridge 4, the insertion direction D1 of the cartridge 4 and the direction in which the liquid supply portion 442 extends intersect each other, such that the insertion direction D1 can be set to the horizontal direction and the direction in which the liquid supply portion 442 extends can be set to the direction including the gravity direction component, and it is thus possible to reduce the amount of liquid remaining in the liquid containing portion 450 without being consumed while improving the operability of the cartridge 4.

In addition, according to the above embodiment, as illustrated in FIGS. 14 and 22, the cartridge 4 can be smoothly moved in the insertion direction D1 by including the cartridge guide portion 447. In particular, in the present embodiment, the outer shape of the cartridge 4 is the largest in the insertion direction D1. Therefore, the cartridge 4 includes the cartridge guide portion 447 guided in the insertion direction, such that the cartridge 4 can be smoothly moved in the insertion direction D1. In addition, as illustrated in FIG. 22, the cartridge guide portion 447 includes the first cartridge guide portion 447*a* formed on the first side wall 45 and the second cartridge guide portion 447*b* formed on the second side wall 46 corresponding to the first side wall 45. As a result, the cartridge guide portions 447 can be provided on both sides of the cartridge 4 in the width direction, and an insertion posture of the cartridge 4 can thus be made stable when the cartridge 4 is moved in the insertion direction with respect to the cartridge mounting portion 6.

In addition, according to the above embodiment, as illustrated in FIG. 14, the circuit board 50 having the cartridge side terminal 521 is arranged at the corner portion 89 where the front wall 42 and the bottom wall 44 intersect each other. As a result, by moving the cartridge 4 with respect to the accommodation chamber 61 of the cartridge mounting portion 6 in the insertion direction, the cartridge side terminal 521 and the device side terminal 721 can be easily brought into contact with each other. In particular, in the present embodiment, as illustrated in FIG. 17, the cartridge 4 has the terminal positioning portion 906 at the corner portion 89, such that the cartridge side terminal 521 and the device side terminal 721 can be reliably brought into contact with each other in the mounting process.

In addition, according to the above embodiment, as illustrated in FIG. 15, the cartridge 4 includes the liquid container 401 and the adapter 402, and a degree of freedom in design can thus be improved. For example, a common adapter 402 can be used for a plurality of liquid containers 401 and 401B whose liquid containing portions 450 have different capacities. In addition, the cartridge 4 includes the liquid container 401 and the adapter 402, such that the liquid container 401 can be removed from the adapter 402 and a new liquid container 401 can be attached to the adapter 402, after the liquid has been consumed. As a result, recyclability of the cartridge 4 is improved.

In addition, in the present embodiment, the adapter 402 that can be commonly used for different types of liquid containers 401 and 401B is provided with the terminal positioning portion 906, the supply portion positioning portion 448, the cartridge side identification member 430, the cartridge engaging portion 497, and the cartridge guide portion 447, which are elements cooperating with the cartridge mounting portion 6. As a result, even though the types of liquid containers 401 are different from each other, the same type of adapter 402 can be used, and a manufacturing cost of the cartridge 4 can thus be reduced. In addition, as a result, a structure of the liquid containers 401 and 401B can be simplified.

In addition, according to the above embodiment, as illustrated in FIGS. 27 to 30, after the cartridge 4 is inserted into the accommodation chamber 61 through the insertion/removal opening 674, the liquid introduction portion 642 and the liquid supply portion 442 can be coupled to each other by displacing the opening 614 around the rotation fulcrum 698 toward the gravity direction to arrange the tip 642*b* of the liquid introduction portion 642 in the accommodation chamber 61. As a result, in a process of inserting the cartridge 4 into the accommodation chamber 61 in the horizontal direction, it is possible to prevent the cartridge 4 from colliding with the liquid introduction portion 642 formed in a direction intersecting the insertion direction D1.

B. Other Embodiments

B-1. Other Embodiment 1

In the above embodiment, as illustrated in FIG. 26, the insertion direction D1 is parallel to the horizontal direction, but is not limited thereto. In another embodiment, the insertion direction D1 may be inclined with respect to the horizontal direction as long as it has a horizontal direction component. For example, the insertion direction D1 may be inclined within a range of greater than 0° and 15° or less with respect to the horizontal direction. In addition, in the above embodiment, in the mounted state of the cartridge 4, the central axis CA2 of the liquid supply portion 442 is inclined with respect to the gravity direction. However, the central axis CA2 of the liquid supply portion 442 may also be a direction along the gravity direction.

B-2. Other Embodiment 2

In the above embodiment, as illustrated in FIGS. 28 to 30, the cartridge 4 rotationally moves around the rotation fulcrum 698 in the coupling direction D2, such that the liquid supply portion 442 and the liquid introduction portion 642 are coupled to each other, but a manner in which the liquid supply portion 442 and the liquid introduction portion 642 are coupled to each other is not limited thereto. For example, the cartridge 4 may be moved in the −Z direction by moving the entire support member 610 in the −Z direction, such that the liquid supply portion 442 and the liquid introduction portion 642 are coupled to each other. That is, in the terminal coupling process, the support member 610 may move in the −Z direction, which is the gravity direction, to displace the opening 614 in the −Z direction, which is the gravity direction, such that the tip 642*b* of the liquid introduction portion 642 may be arranged in the accommodation chamber 61 through the opening 614. In addition, a position of the support member 610 may be fixed, and the liquid introduction portion 642 may move to be coupled to the liquid supply portion 442.

B-3. Other Embodiment 3

In the above embodiment, as illustrated in FIG. 15, the liquid container 401 and the adapter 402 are separate bodies. However, the liquid container 401 and the adapter 402 may be integrated with each other.

B-4. Other Embodiment 4

The present disclosure is not limited to an ink jet printer and an ink cartridge thereof, but can be applied to any printing device that ejects a liquid other than ink, and a cartridge thereof. For example, the present disclosure can be applied to the following various printing devices and cartridges thereof.

(1) Image recording device such as facsimile machine
(2) Printing device that ejects color material used for manufacturing color filter for image display device such as liquid crystal display
(3) Printing device that ejects electrode material used for forming electrode such as organic electroluminescence (EL) display or field emission display (FED)
(4) Printing device that ejects liquid containing bioorganic substance used for manufacturing biochip
(5) Sample printing device as precision pipette
(6) Printing device of lubricating oil
(7) Printing device of resin liquid
(8) Printing device that ejects lubricating oil onto precision machine such as watch or camera in pinpoint manner
(9) Printing device that ejects transparent resin liquid such as ultraviolet curable resin liquid onto substrate in order to form microhemispherical lens (optical lens) or the like used for optical communication element or the like

(10) Printing device that ejects acidic or alkaline etchant in order to etch substrate or the like

(11) Printing device including liquid ejecting head that ejects other arbitrary minute amounts of droplets.

Note that the "droplet" refers to a state of the liquid discharged from the printing device, and includes those leaving a trail in a granular shape, a tear shape, or a thread shape. In addition, the "liquid" mentioned here may be any material that can be ejected by the printing device. For example, the "liquid" may be a material in a state when a substance is in a liquid phase, and materials in a liquid state in which viscosity is high or low and materials in a liquid state such as sol, gel water, other inorganic solvents, organic solvents, solutions, liquid resins, and liquid metals are also included in the "liquid". In addition, not only a liquid as one state of a substance, but also a liquid in which particles of a functional material formed of a solid substance such as a pigment or a metal particle are dissolved, dispersed, or mixed in a solvent is included in the "liquid". In addition, typical examples of the liquid can include the ink as described in the above embodiment, liquid crystal, or the like. Here, the ink includes general water-based inks, oil-based inks, and various liquid compositions such as gel inks and hot melt inks.

C. Other Aspects

The present disclosure is not limited to the above-described embodiment, and can be realized by various configurations without deviating from the spirit thereof. For example, technical features of an embodiment corresponding to technical features in each of aspects described below can be appropriately replaced or combined in order to solve some or all of the problems described above or achieve some or all of the effects described above. In addition, when the technical feature is not described as essential in the present specification, the technical feature can be appropriately deleted.

(1) According to a first aspect of the present disclosure, there is provided a cartridge detachably mounted in a cartridge mounting portion of a printing device including a liquid introduction portion that receives a liquid and a device side valve body that opens/closes an introduction portion flow path which is a flow path of the liquid introduction portion. The cartridge includes a liquid containing portion that contains the liquid, and a liquid supply portion that has a supply opening formed at a tip, communicates with the liquid containing portion, is coupled to the liquid introduction portion, and includes a cartridge side valve mechanism that opens/closes a supply portion flow path which is the flow path of the liquid supply portion, the cartridge side valve mechanism includes a cartridge side valve seat in which a cartridge side valve hole is formed, a cartridge side valve body that stops the cartridge side valve hole and has a tip surface positioned on a side of the supply opening, and a cartridge side urging member that urges the cartridge side valve body in a direction toward the cartridge side valve seat, and the cartridge side valve body has a protrusion that protrudes from the tip surface and pushes the device side valve body to open the device side valve body. According to this aspect, it is possible to easily open the device side valve body of the liquid introduction portion by using the protrusion of the cartridge side valve body.

(2) In the above aspect, the protrusion may have any one of a cylindrical shape and a prism shape. According to this aspect, the protrusion can be formed in a simple shape.

(3) According to a second aspect of the present disclosure, there is provided a printing device in which a cartridge is mounted. The cartridge includes a liquid supply portion and a cartridge side valve body for opening/closing a supply portion flow path which is a flow path of the liquid supply portion, the cartridge side valve body having a protrusion that protrudes from a tip surface. Further, the printing device includes an ejecting head that ejects a liquid, and a cartridge mounting portion in which the cartridge is mounted and which includes a liquid introduction portion coupled to the liquid supply portion and receiving the liquid, the liquid introduction portion has an introduction portion opening formed at a tip, an introduction portion flow path which is a flow path, and a device side valve body that opens/closes the introduction portion flow path, and the device side valve body is arranged at a position at which the device side valve body is pushed by the protrusion to be opened. According to this aspect, it is possible to easily open the device side valve body by using the protrusion.

(4) In the above aspect, the device side valve body may be positioned in the introduction portion flow path without protruding from the introduction portion opening. According to this aspect, it is possible to reduce a possibility that the liquid attached to the device side valve body will leak to the outside.

(5) According to a third aspect of the present disclosure, there is provided a printing system. The printing system includes the cartridge of the above aspect, and the printing device of the above aspect, as the cartridge is moved downward, the liquid introduction portion and the liquid supply portion are coupled to each other, and in a supply portion coupling process in which the liquid introduction portion and the liquid supply portion are coupled to each other, the device side valve body is opened earlier than the cartridge side valve body. According to this aspect, in the supply portion coupling process, the device side valve body is opened earlier than the cartridge side valve body, such that it is possible to reduce a possibility that air will remain between the device side valve body and the cartridge side valve body. Accordingly, it is possible to suppress the remaining air from being compressed in the supply portion coupling process, such that it is possible to suppress an external force, which is to be applied to the cartridge in order to couple the liquid supply portion and the liquid introduction portion each other, from being excessively large.

(6) In the above embodiment, the liquid introduction portion further has a device side valve seat that is positioned in the introduction portion flow path and has a device side valve hole, and a device side urging member that is positioned in the introduction portion flow path and urges the device side valve body in a direction toward the device side valve seat, and a first urging force, which is an urging force of the cartridge side urging member with respect to the cartridge side valve body, may be set to be larger than a second urging force, which is an urging force of the device side urging member with respect to the device side valve body, in a state before coupling between the liquid introduction portion and the liquid supply portion is started, such that the device side valve body is opened earlier than the cartridge side valve body in the process in which the liquid introduction portion and the liquid supply portion are coupled to each other. According to this aspect, a magnitude relationship between the first urging force and the second urging force is set, such that it is possible to easily perform setting so that the device side valve body is opened earlier than the cartridge side valve body.

(7) In the above aspect, in a decoupling process in which the liquid introduction portion and the liquid supply portion are decoupled from each other, the cartridge side valve body may be closed earlier than the device side valve body. According to this aspect, in the decoupling process, when the cartridge side valve body is in the opened state, the liquid of the liquid supply portion can be made to flow to the liquid introduction portion. As a result, it is possible to reduce a possibility that the liquid will leak from the liquid supply portion to the outside in the decoupling process.

The present disclosure can be realized in an aspect such a method of manufacturing a cartridge, a cartridge side valve mechanism, a device side valve mechanism, or the like, in addition to the above aspects.

What is claimed is:

1. A cartridge configured to be mounted in and detached from a cartridge mounting portion of a printing device including a liquid introduction portion that receives a liquid and a device side valve body that opens/closes an introduction portion flow path which is a flow path of the liquid introduction portion, the cartridge comprising:

a liquid containing portion that contains the liquid; and a liquid supply portion that has a supply opening formed at a tip, communicates with the liquid containing portion, is coupled to the liquid introduction portion, and includes a cartridge side valve mechanism that opens/closes a supply portion flow path which is the flow path of the liquid supply portion, wherein the cartridge side valve mechanism includes a cartridge side valve seat in which a cartridge side valve hole is formed, a cartridge side valve body that stops the cartridge side valve hole and has a tip surface positioned on a side of the supply opening, and a cartridge side urging member that urges the cartridge side valve body in a direction toward the cartridge side valve seat, the cartridge side valve body has a protrusion that protrudes from the tip surface and pushes the device side valve body to open the device side valve body, and when the cartridge is mounted in the cartridge mounting portion, the protrusion protrudes inside the device side valve body into the introduction portion flow path.

2. The cartridge according to claim 1, wherein the protrusion has any one of a cylindrical shape and a prism shape.

3. A printing system comprising:

the cartridge according to claim 1; and the printing device in which the cartridge is mounted, wherein the printing device includes an ejecting head that ejects the liquid, the liquid introduction portion is coupled to the liquid supply portion and receives the liquid, the liquid introduction portion has an introduction portion opening formed at a tip, the device side valve body is arranged at a position at which the device side valve body is pushed by the protrusion to be opened, as the cartridge is moved downward, the liquid introduction portion and the liquid supply portion are coupled to each other, and in a supply portion coupling process in which the liquid introduction portion and the liquid supply portion are coupled to each other, the device side valve body is opened earlier than the cartridge side valve body.

4. The printing system according to claim 3, wherein the liquid introduction portion further has a device side valve seat that is positioned in the introduction portion flow path and has a device side valve hole, and a device side urging member that is positioned in the introduction portion flow path and urges the device side valve body in a direction toward the device side valve seat, and a first urging force, which is an urging force of the cartridge side urging member with respect to the cartridge side valve body, is set to be larger than a second urging force, which is an urging force of the device side urging member with respect to the device side valve body, in a state before coupling between the liquid introduction portion and the liquid supply portion is started, such that the device side valve body is opened earlier than the cartridge side valve body in the process in which the liquid introduction portion and the liquid supply portion are coupled to each other.

5. The printing system according to claim 3, wherein in a decoupling process in which the liquid introduction portion and the liquid supply portion are decoupled from each other, the cartridge side valve body is closed earlier than the device side valve body.

6. The cartridge according to claim 1, wherein, when the cartridge is mounted in the cartridge mounting portion and the protrusion protrudes inside the device side valve body into the introduction portion flow path, the tip surface abuts the device side valve body and is kept outside of the introduction portion flow path.

7. A printing device in which a cartridge is mounted, the cartridge including a liquid supply portion and a cartridge side valve body for opening/closing a supply portion flow path which is a flow path of the liquid supply portion, the cartridge side valve body having a protrusion that protrudes from a tip surface, the printing device comprising:

an ejecting head that ejects a liquid; and a cartridge mounting portion in which the cartridge is mounted and which includes a liquid introduction portion coupled to the liquid supply portion and receiving the liquid, wherein the liquid introduction portion has an introduction portion opening formed at a tip, an introduction portion flow path which is a flow path, and a device side valve body that opens/closes the introduction portion flow path, the device side valve body is arranged at a position at which the device side valve body is pushed by the protrusion to be opened, and when the cartridge is mounted in the cartridge mounting portion, the device side valve body receives the protrusion inside the device side valve body into the introduction portion flow path.

8. The printing device according to claim 7, wherein the device side valve body is positioned in the introduction portion flow path without protruding from the introduction portion opening.

9. The printing device according to claim 7, wherein, when the cartridge is mounted in the cartridge mounting portion and the device side valve body receives the protrusion inside the device side valve body into the introduction portion flow path, the device side valve body abuts the tip surface and keeps the tip surface outside of the introduction portion flow path.

* * * * *